US007484634B2

(12) United States Patent
Apps

(10) Patent No.: US 7,484,634 B2
(45) Date of Patent: Feb. 3, 2009

(54) CONTAINER WITH COLLAPSIBLE WALL

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 403 days.

(21) Appl. No.: 11/131,772

(22) Filed: May 17, 2005

(65) Prior Publication Data

US 2006/0260976 A1 Nov. 23, 2006

(51) Int. Cl.
*B65D 6/12* (2006.01)

(52) U.S. Cl. ..... 220/7; 220/6

(58) Field of Classification Search ..... 220/6, 220/7; 13/234, 294, 242; 16/234, 294, 242
See application file for complete search history.

(56) References Cited

U.S. PATENT DOCUMENTS

| | | | | |
|---|---|---|---|---|
| 3,835,792 | A | 9/1974 | Wharton | |
| 4,674,647 | A | 6/1987 | Gyenge et al. | |
| 5,094,356 | A | 3/1992 | Miller | |
| 5,199,592 | A | 4/1993 | Reiland et al. | |
| 7,281,637 | B2 * | 10/2007 | Hadar | 220/6 |
| 2002/0070215 | A1 | 6/2002 | Walsh et al. | |
| 2004/0200833 | A1 | 10/2004 | Dubois et al. | |

FOREIGN PATENT DOCUMENTS

| | | |
|---|---|---|
| DE | 2 020 581 | 11/1971 |
| EP | 0 690 003 A1 | 1/1996 |
| GB | 2 357 078 | 6/2001 |
| WO | WO 98/40199 | 9/1998 |
| WO | 00/48929 | 8/2000 |

OTHER PUBLICATIONS

United Kingdom Search Report, Aug. 4, 2006.
United Kingdom Search Report for UK Application No. GB0609645.7, Jul. 25, 2008.

* cited by examiner

*Primary Examiner*—Anthony D Stashick
*Assistant Examiner*—Harry A Grosso
(74) *Attorney, Agent, or Firm*—Carlson, Gaskey & Olds

(57) ABSTRACT

A container having at least one wall moveable between an upright position and a collapsed position on the floor. A hinge connecting the wall to the base includes a first axis and a second axis offset from the first axis. The hinge is locked when the wall is in the upright position to prevent rotation about the second axis but permit rotation about the first axis.

21 Claims, 25 Drawing Sheets

CONTAINER WITH COLLAPSIBLE WALL

BACKGROUND OF THE INVENTION

The present invention relates generally to pallets, and more particularly to a field bin. A field bin is generally a pallet with upstanding walls. Thus, some of these features are applicable to pallets, containers and to collapsible containers independently.

There are numerous considerations in the design of a pallet or field bin. In addition to the acquisition costs, there are several costs in using and maintaining a field bin, including the cost of shipping, periodic cleaning, and repairs.

Making the field bin collapsible can reduce shipping costs. Minimizing the height of the collapsed field bin reduces the cost of shipping the field bin when empty. Decreasing the weight of the container also decreases shipping costs.

Damage to the field bin is largely incurred from the handling of the field bin with fork trucks. The runners, columns and base have direct contact with the blades and are therefore subject to the most abuse. The walls are also likely to be damaged from the repeated collapsing and erecting of the container. Although the damage cannot be eliminated, the time and cost required to repair the field bin should be minimized.

The collapsible walls of field bins often include drop walls or doors for easier access to product in the bottom of the container. Generally, each wall includes a cutout opening upwardly from approximately a mid-height level on the wall. The drop door is hingeably connected in the cutout of the wall. In order to permit the door to be opened fully, i.e. such that it is parallel to the wall and lies adjacent the wall, double hinges that permit rotation about two offset axes have been used to connect the doors to the walls. However, the cutouts reduce the strength and stability of the walls. If the doors are open, the load supportable by the walls is significantly reduced. Opening a door on a bin on which other bins are stacked could cause the stack to fail.

In order to reduce the stacking height of empty containers, some collapsible containers provide at least the longer side walls of the containers with double hinges, i.e., hinges that permit the walls to pivot about either of two vertically spaced axes, so that one wall can lie parallel and flat upon the other when both walls are in the collapsed position. Further, the walls can be collapsed in a non-sequential order. In other words, either wall can be folded down onto the base first. However, the double hinge connecting the side walls to the base does not provide a rigid connection between the side wall and the base when the side wall is in the upright position. The double hinges permit some undesired movement of the side walls relative to the base.

SUMMARY OF THE INVENTION

A pallet includes a plurality of supports supporting a floor. The supports each include a plurality of columns integrally-molded with at least one runner. The columns snap-fit to the floor.

At least one wall is moveable about a hinge between an upright position and a collapsed position. The hinge includes a first axis and a second axis offset from the first axis. The hinge is locked when the wall is in the upright position to prevent rotation about the second axis but permit rotation about the first axis. The hinge is unlocked when the wall is not in the upright position in order to permit rotation about the second axis.

One or more of the walls may include a cutout opening upwardly from an approximate mid-height level on the wall. A drop wall or drop door is pivotably connected to the wall in the cutout. A hinge assembly connects the door to the wall and includes a first hinge pin and a second hinge pin. The first hinge pin and the second hinge pin are pivotable relative to one another about a third axis offset from the first hinge pin and the second hinge pin. This permits the door to open completely relative to the wall to a position at least substantially parallel to and adjacent the wall. Interlocking tabs on the door and the wall prevent the door from opening unless the door is first lifted vertically relative to the wall. This prevents the door from being opened when another bin or other container is stacked on the wall.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
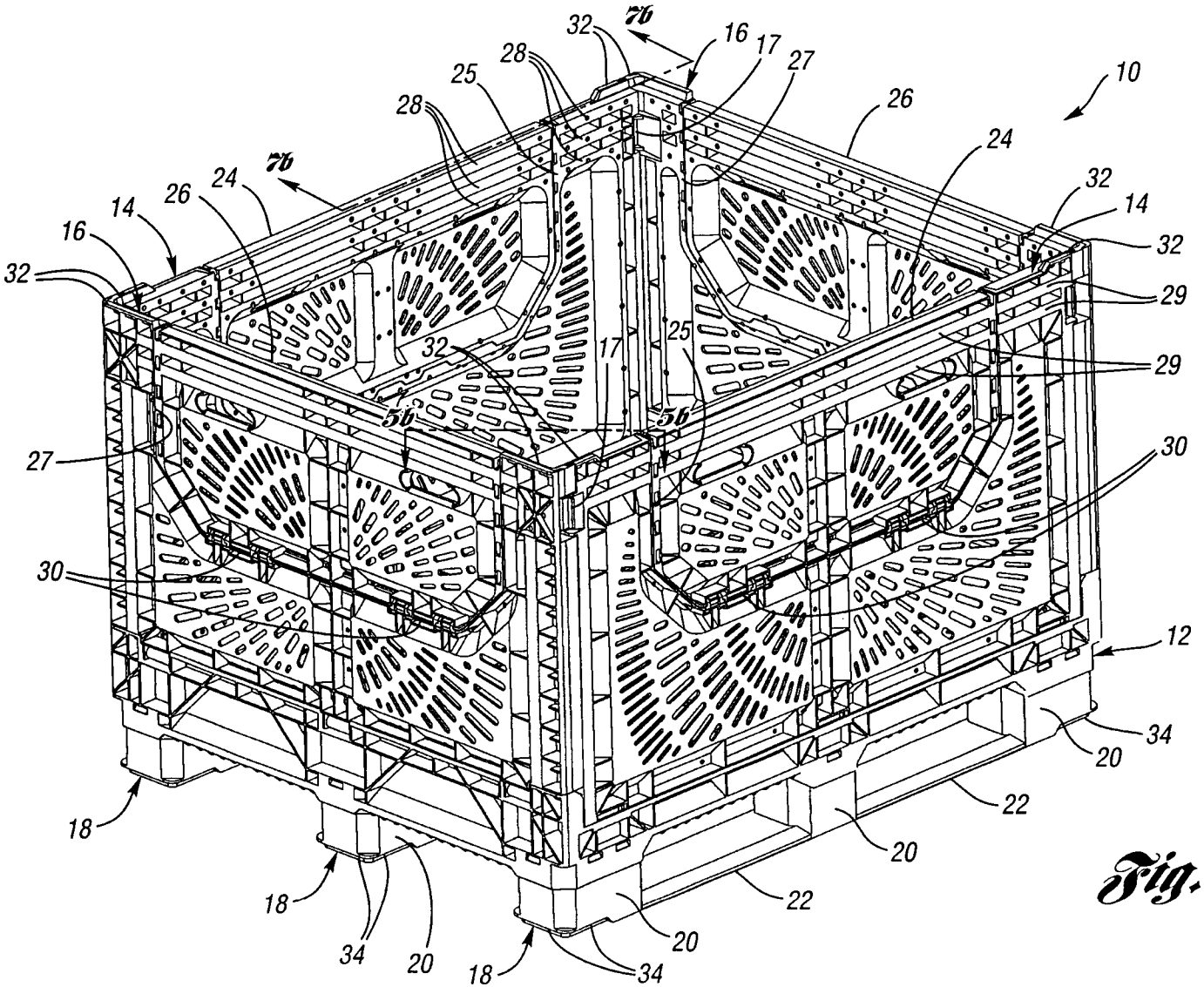
FIG. 1 is a perspective view of a field bin according to one embodiment of the present invention.

A pallet or field bin 10 according to one embodiment of the present invention is shown in FIG. 1. The bin 10 includes a base 12 and a pair of opposed side walls 14 extending upwardly from side edges of the base 12. End walls 16 extend upwardly from end edges of the base 12 and are releasably connected to the side walls 14 by latches 17.

A plurality (three in this embodiment, although more or fewer could be used) of supports 18 are snap fit into the bottom of the base 12. Each support 18 includes a plurality (three in this embodiment, although more or fewer could be used) of columns 20 between which extends runners 22. The columns 20 and runners 22 are integrally molded together as a single unitary construction.

Each side wall 14 includes a drop wall or drop door 24 hingeably connected to the side wall 14 in an upwardly opening cutout 25 in the side wall 14. Similarly, each end wall 16 includes an upwardly opening cutout 27 into which is hingeably connected a drop door 26. Each of the doors 24, 26 is preferably connected at approximately a mid-height level of the wall 14, 16 via one or more hinges 30. Although different hinges could be used, the hinges 30 connecting the side wall drop doors 24 are preferably identical to those connecting the end wall drop doors 26, in order to provide interchangeability of repair parts. The hinges 30 are closed to the interior of the field bin 10 and are assembled from the exterior of the field bin 10. This prevents food or other contents of the field bin 10 from becoming lodged in the hinges 30. This also facilitates cleaning the hinges 30 with water from the exterior of the field bin 10. The drop doors 24, 26 are shown each having two hinges 30, although it may be desirable to use three hinges 30 to connect each drop door 24, 26 to increase stability of the connection. The hinges 30 can be removed and replaced with minimal tools, such as by prying them out with a screwdriver.

The upper edge of the end walls 16 and a portion of the upper edge of the side walls 14 each include a ridge 32 protruding upwardly higher than the doors 24, 26. The ridge 32 is also narrower than the end walls 16 and side walls 14 and is complementary to recesses 34 formed on the ends and portions of the sides of the bottom of the supports 18. The ridges 32 would be received in the recesses 34 of a similar bin 10 stacked on the bin 10 to create a more stable stack. Along the upper edge of the side walls 14, end walls 16 and drop doors 24, 26 is a corrugated band of alternating inner and outer elongated panels 28, 29.

Figure 2:
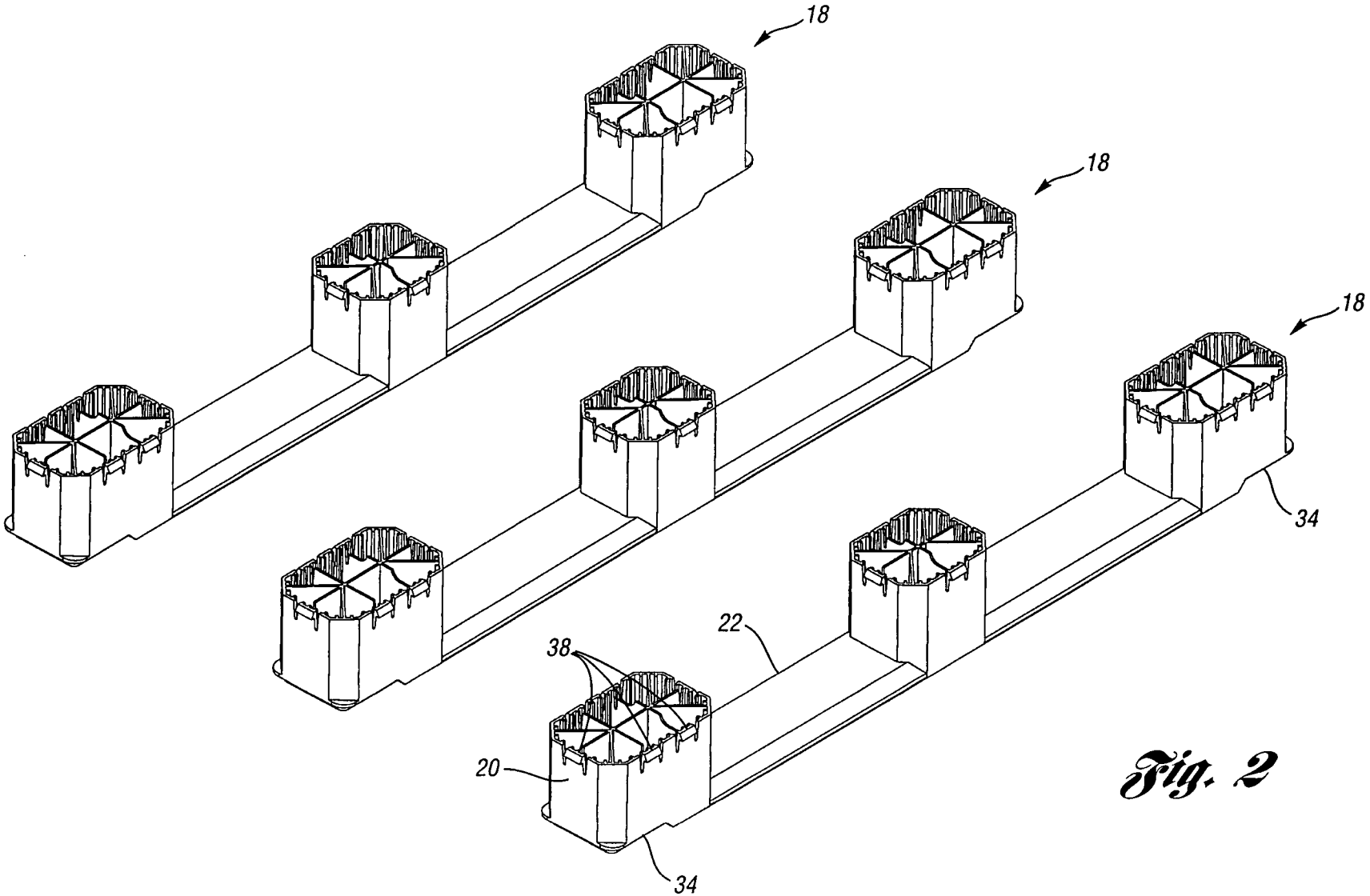
FIG. 2 is a perspective view of the supports of the bin of FIG. 1.

Referring to FIG. 2, the supports 18 each include a plurality of snap-fit tabs 38 integrally molded on upper ends of the columns 20. Although not required, the supports 18 are preferably identical and interchangeable in order to reduce the number of repair parts. Also, making the columns 20 integral with the runners 22 reduces the total number of parts and simplifies repair. Further, it eliminates a potential failure point in the connection between the columns 20 and runners 22.

Figure 3:
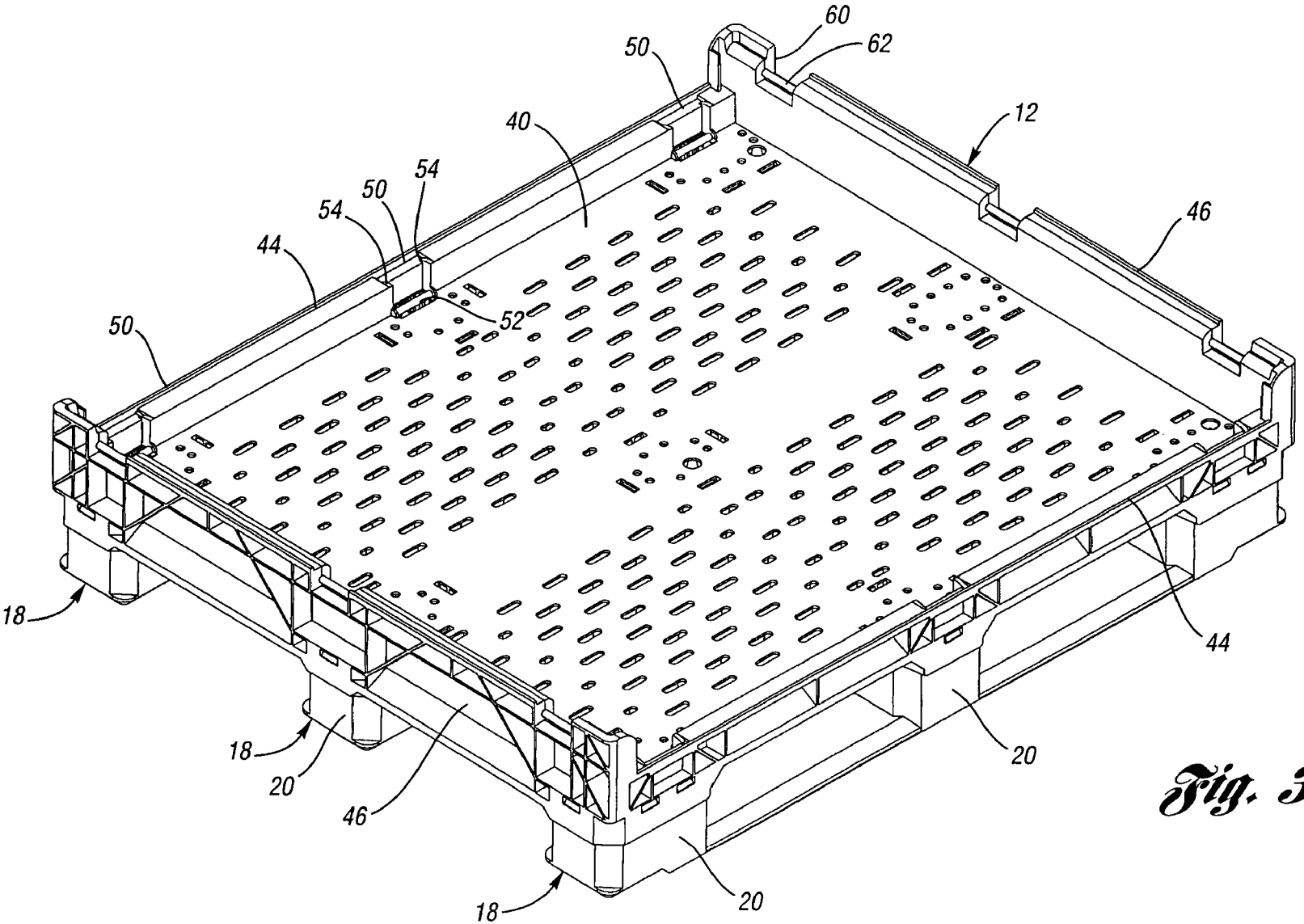
FIG. 3 is a perspective view of the base and supports of FIG. 2.

FIG. 3 illustrates the base 12 on the supports 18. The base 12 includes a generally planar floor 40 having a plurality of drainage holes formed therein. The base 12 further includes lower side wall portions 44 extending upwardly from side edges 12 and lower end wall portions 46 extending upwardly from end edges of the base 12. The floor 40, lower side wall portions 44 and lower end wall portions 46 are all integrally molded to form a unitary construction.

The lower side wall portions 44 each include a plurality of lower hinge members 50 integrally formed therein. Each lower hinge member 50 includes a hinge pin 52 spaced slightly inwardly from the rest of the lower side wall portion 44. A pair of arcuate surfaces 54 are formed on either side of the lower hinge member 50. The center of the arcuate surfaces 54 is approximately coaxial with the axis through the hinge pin 52. The function of the arcuate surfaces 54 will be described below with respect to their interaction with the side walls 14 (FIG. 1).

Each of the lower end wall portions 46 includes a plurality of lower hinge members 60. A hinge pin 62 extends across each lower hinge member 60. The hinge members 60 are open to the interior of the field bin 10 and are protected from the exterior, particularly from the forks of a fork truck, by the end walls 16.

It should be noted that the lower hinge members 50, 60 formed in the base 12 are each aligned with the columns 20. This alignment is chosen to avoid contact of the fork truck blades with the hinges.

Figure 4:
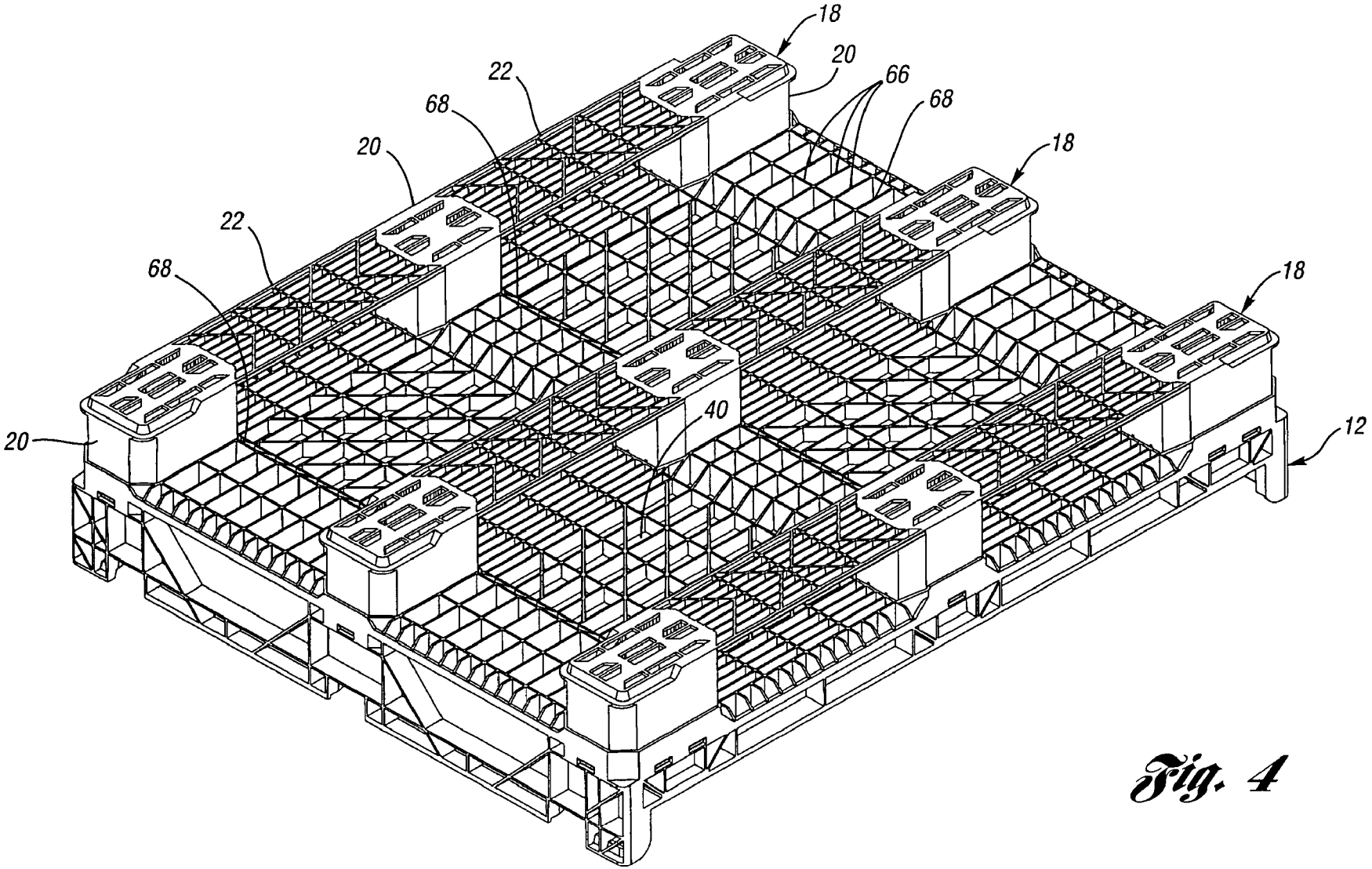
FIG. 4 is a bottom perspective view of the base and supports of FIG. 3.

FIG. 4 is a bottom perspective view of the base 12 and supports 18 of FIG. 3. As shown, the underside of the base 12 includes a plurality of perpendicular and diagonal ribs 66 extending downward from the floor 40 for reinforcement. Ribs or portions of ribs 66 that are aligned with the columns 20 in a direction perpendicular to the runners 22 are taller and extend downward from the base 12 and floor 40 substantially farther than the other areas (approximately twice as far) in order to form cross-supports 68 integrally with the base 12. This eliminates the need for runners perpendicular to the runners 22 and provides clearance for the forks of the fork truck between the base 12 and runners 22. The cross-supports 68 also leave enough room for blades of a fork truck between the cross-supports 68 and the floor.

Figure 5:
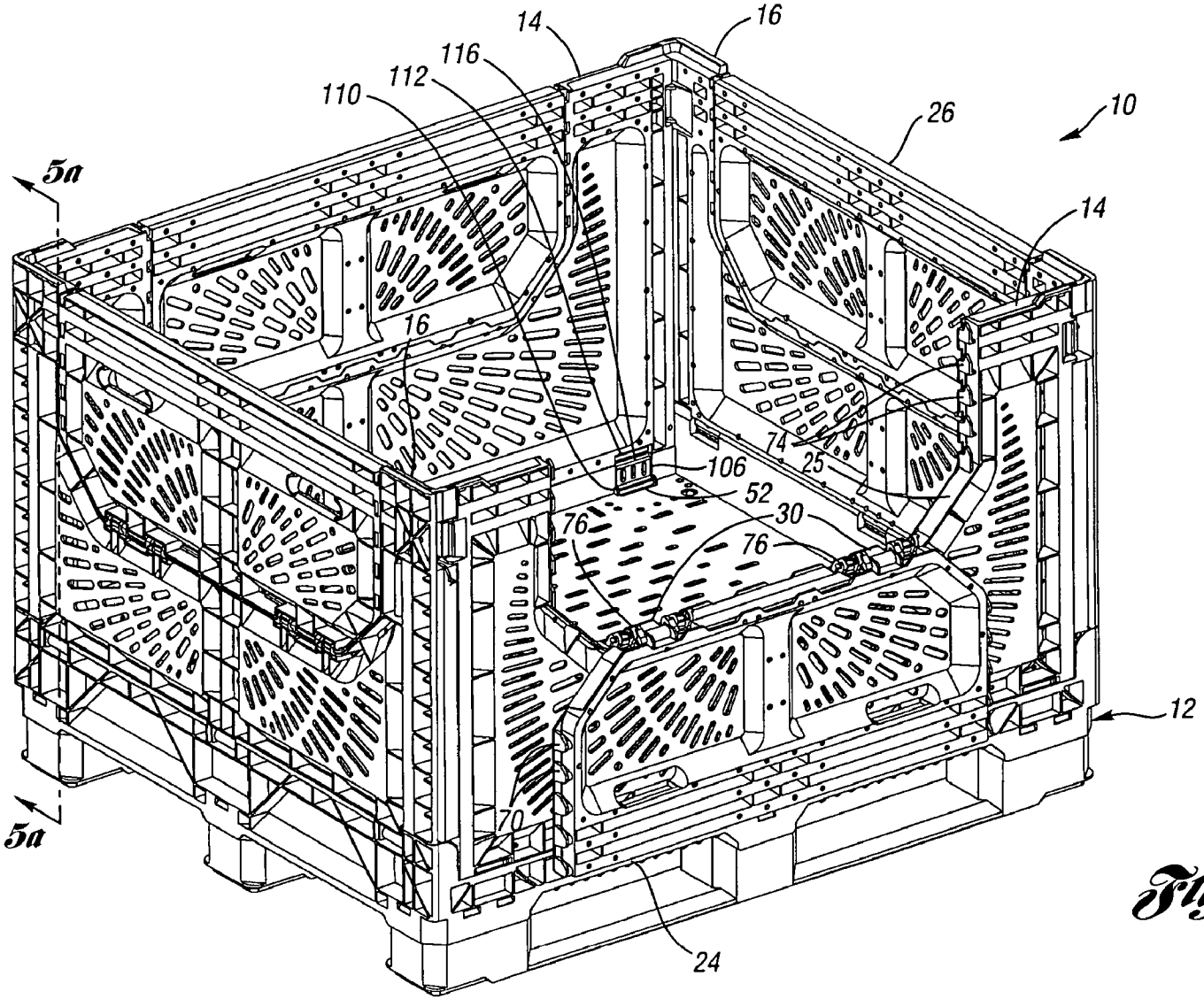
FIG. 5 illustrates the bin of FIG. 1 with one of the side doors open.

FIG. 5 is a perspective view of the bin 10 shown with a side wall drop door 24 in the open position parallel to and adjacent a side wall 14. Again, the hinges 30 connecting the drop door 24 to the side wall 14 are preferably, but not necessarily identical to the hinges 30 connecting the drop doors 26 to the end walls 16. Each hinge 30 includes a hinge assembly 76 connecting a lower edge of the drop door 24 to a bottom edge of the cutout 25 in the side wall 14. The side edges of the drop door 24 include interlocking tabs 70 that interlock with interlocking cleats 74 on the side edges of the cutout 25. The drop door 24 must be lifted vertically for the tabs 70 to clear the cleats 74. The door 24 is then dropped or pushed down to lock the tabs 70 behind the cleats 74. This prevents the door 24 from being opened when another bin or container is stacked on the bin 10. Detents may also be provided to retain the door 24 in and/or out of position in the cutout 25.

Figure 5A:
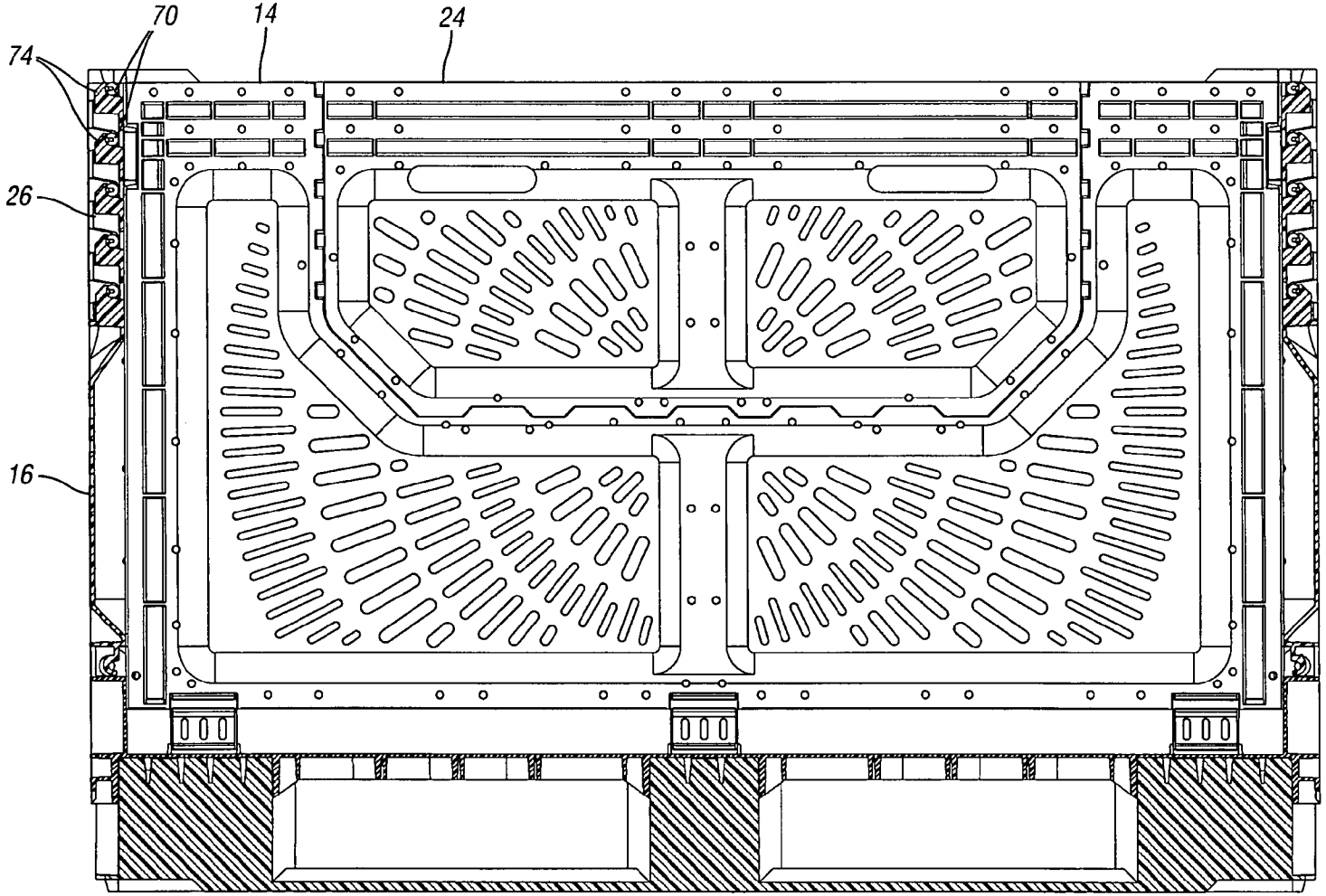
FIG. 5A is a partial section view taken along line 5A-5A of FIG. 5.

FIG. 5A is a partial section view along line 5A-5A to show the interlocking tabs 70 on the drop door 26 interlocked with the interlocking cleats 74 on the end wall 16. The drop door 26 and its connection to end wall 16 may be identical to the drop door 24 and its connection to side wall 14. As can be seen in the drawing, the drop door 26 must be lifted vertically for the interlocking tabs 70 to be released from the interlocking cleats 74 so that the drop door 26 can be opened.

As can also be seen in FIG. 5, the side walls 14 are each connected to the hinge pins 52 on the base 12 by a hinge member 106. The hinge member 106 includes a lower hinge receiver 110 into which the hinge pin 52 of the base 12 is rotatably snap fit. The hinge member 106 also includes an upper hinge receiver 112 into which is rotatably snap fit a hinge pin 116 integrally formed with a lower edge of the side wall 14. As shown, the hinge members 106 are assembled on the interior of the field bin 10, and they are protected from the exterior, particularly from the forks of fork trucks, by the walls 14.

Figure 5B:
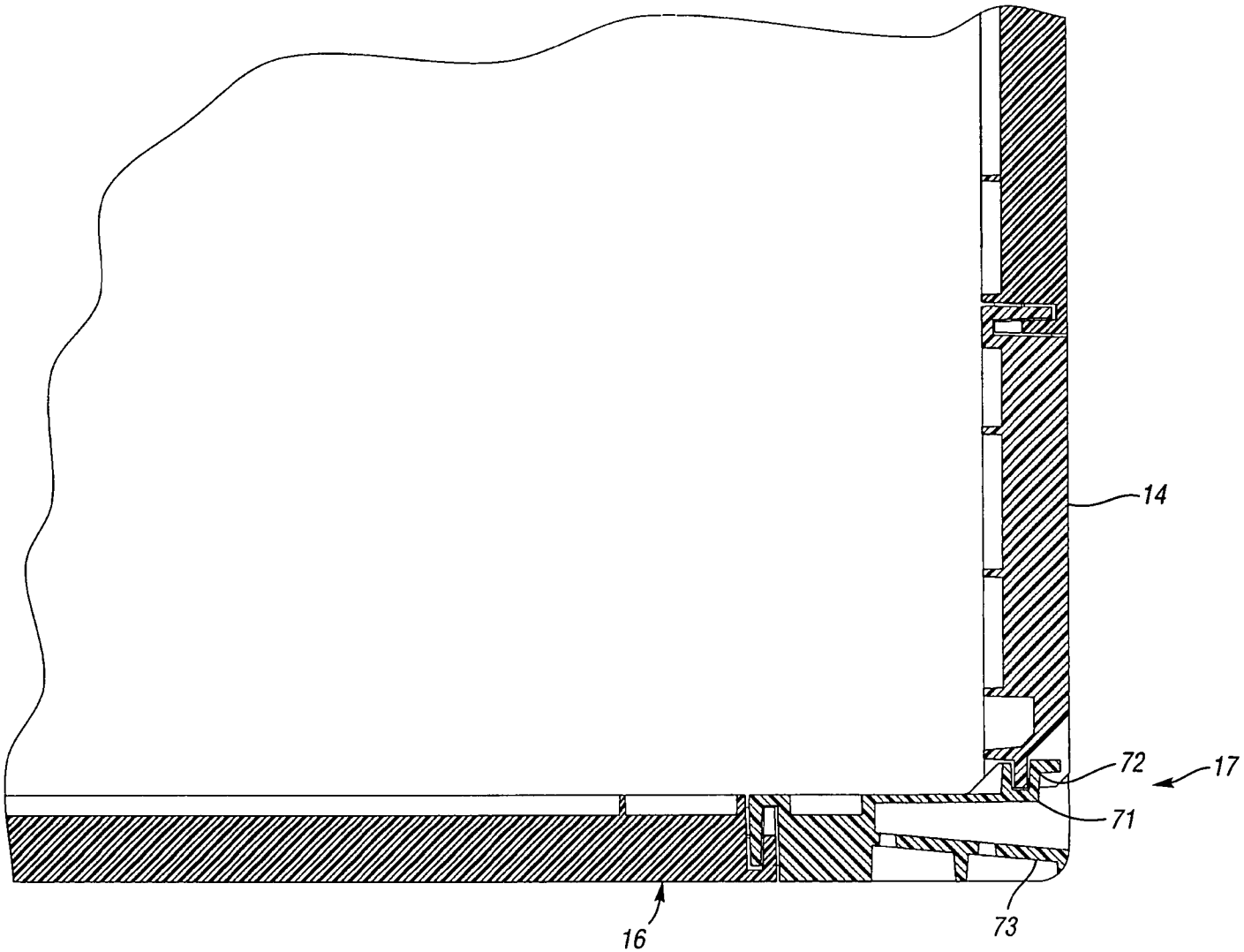
FIG. 5B is a partial section view taken along line 5B-5B of FIG. 1.

FIG. 5B is a partial section view taken along line 5B-5B of FIG. 1. to illustrate the latch 17 in more detail. The latch 17 includes a flexible arm 71 cantilevered from the end wall 16 and having a recess into which snaps a tab 72 protruding from the side wall 14. The end wall 16 also includes a wall 73 spaced outwardly from the flexible arm 71. The wall 73 prevents excessive outward deformation of the flexible arm 71.

Figure 6:
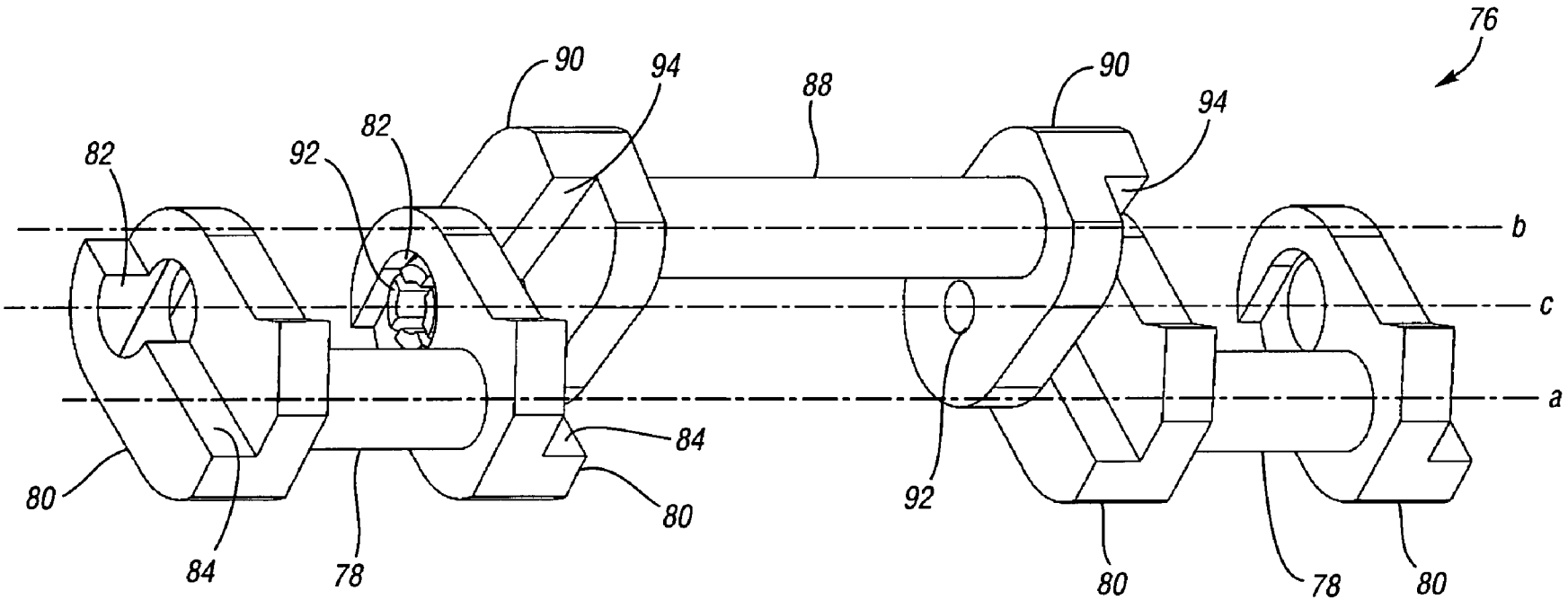
FIG. 6 is a perspective view of one of the hinge members for the doors.

The hinge assembly 76 is shown more clearly in FIG. 6. The hinge assembly 76 includes a pair of first hinge pins 78 connected to outer ends of first pivot arms 80. Each first pivot arm 80 further includes an aperture 82 at its inner end. A rotation stop 84 is formed along the length of each first pivot arm 80.

A second hinge pin 88 is connected to outer ends of second pivot arms 90. Each second pivot arm 90 further includes a hinge pin 92 at an inner end. Each hinge pin 92 is snap fit into an aperture 82 of one of the first pivot arms 80. Each second pivot arm 90 further includes a rotation stop 94 oriented to engage the rotation stop 84 on the first pivot arms 80.

In the hinge assembly 76, the first hinge pins 78 define a first pivot axis, a. The second hinge pin 88 defines a second pivot axis b. The pivot pins 92 and apertures 82 through the inner ends of the first and second pivot arms 80, 90 form a third pivot axis c. In the hinge assembly 76, the first hinge pins 78 and the first pivot axis a are pivotable about the third axis c relative to the second hinge pin 88 and the second axis b. The second hinge pin 88 and first hinge pins 78 can be pivoted about axis c to a position in which they are coaxial, such that the first axis a and the second axis b are aligned.

Figure 7:
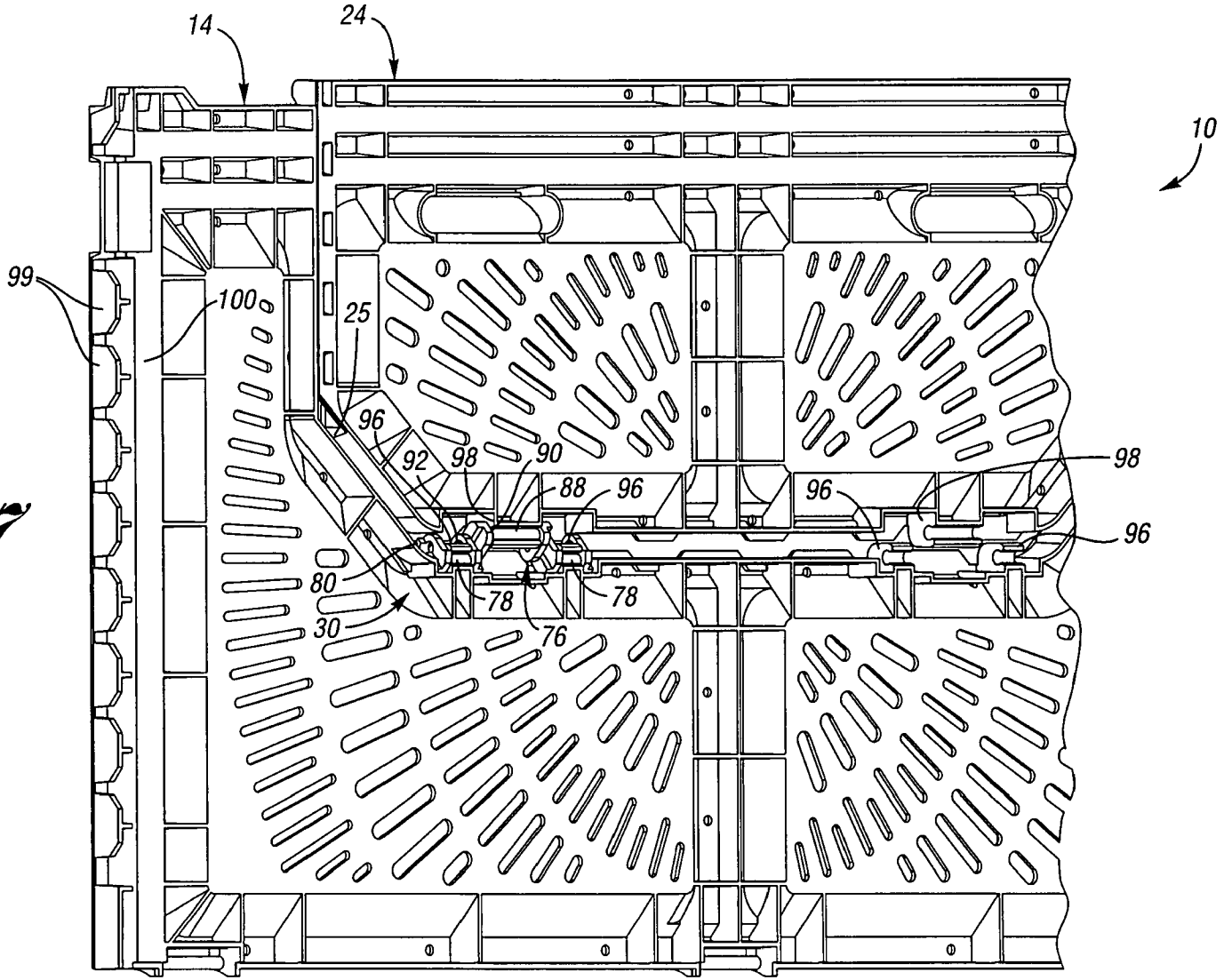
FIG. 7 is a partial perspective view illustrating the connection between a door and a wall.

In FIG. 7, one hinge assembly 76 is shown installed in the bin 10 connecting the door 24 to the side wall 14, while one of the hinge assemblies 76 has been removed for purposes of illustration. The first hinge pins 78 are snap fit and rotatable in hinge receivers 96 formed integrally with a lower edge of the cutout 25. The second hinge pin 88 is rotatably snap fit into a hinge receiver 98 integrally formed on a lower edge of the drop door 24. In FIG. 7, the drop door 24 is lifted vertically relative to the side wall 14, such that the second hinge pin 88 has been lifted vertically relative to the first hinge pins 78. The first hinge pin 78 and second hinge pin 88 both initially move within the plane containing the side wall 14. While the first hinge pins 78 and second hinge pin 88 pivot about the hinge pins 92, the hinge pins 92 and the inner ends of the first and second pivot arms 80, 90 are drawn toward the plane containing the first and second hinge pins 78, 88. When the tabs 70 on the edges of the drop door 24 clear the cleats 74 on the edges of the cutout 25 (FIG. 5), the drop door 24 can be pivoted outwardly and then downwardly to the position shown in FIG. 8.

The side wall 14 includes interlocking tabs 99 protruding laterally from each lateral edge and defining a recess 100 behind the interlocking tabs 99.

Figure 7A:
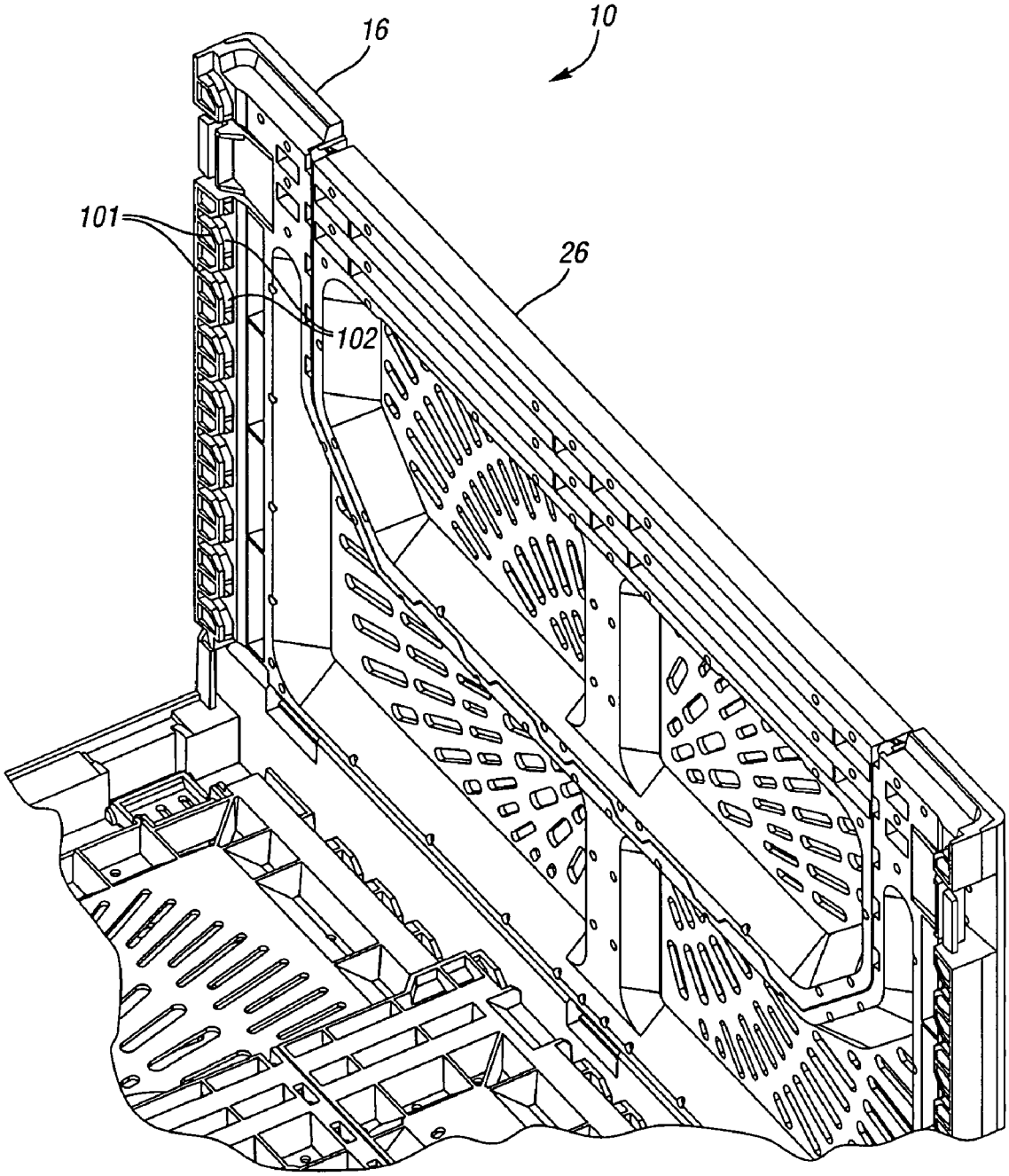
FIG. 7A is a partial perspective interior view of one of the end walls.
Figure 7B:
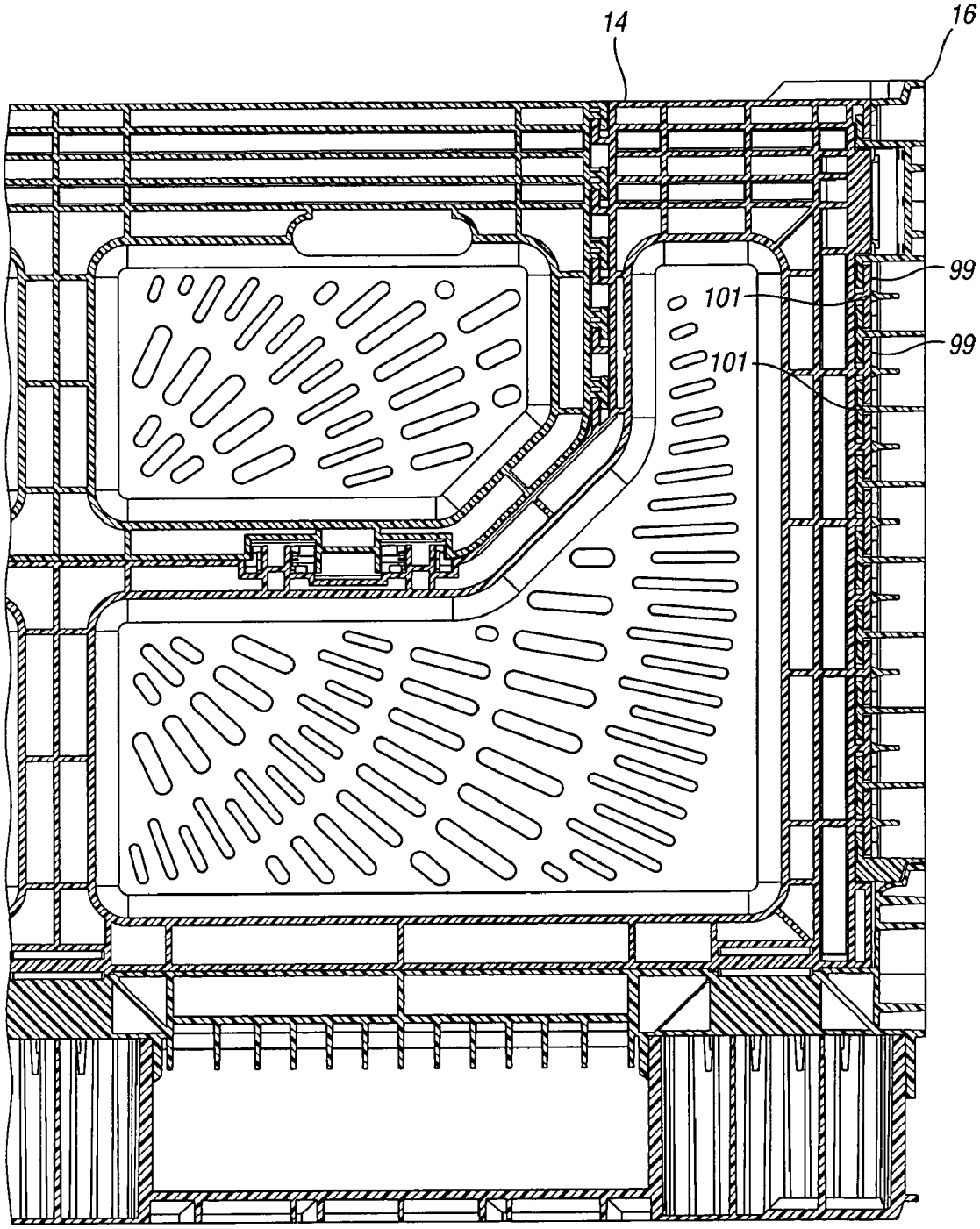
FIG. 7B is a partial section view taken along line 7B-7B of FIG. 1.

FIG. 7A is a partial perspective interior view of one of the end walls 16. The end wall 16 includes a plurality of interlocking tabs 101 protruding inwardly from lateral edges and defining a recess 102 behind the interlocking tabs 101. When assembled, the interlocking tabs 99 of the side wall 14 are received in the recess 102 of the end wall 16 behind the interlocking tabs 101, and the interlocking tabs 101 of the end wall 16 are received in the recess 100 of the side wall 14 behind the interlocking tabs 99. This increases the stability of the connection between the side wall 14 and the end wall 16.

Figure 8:
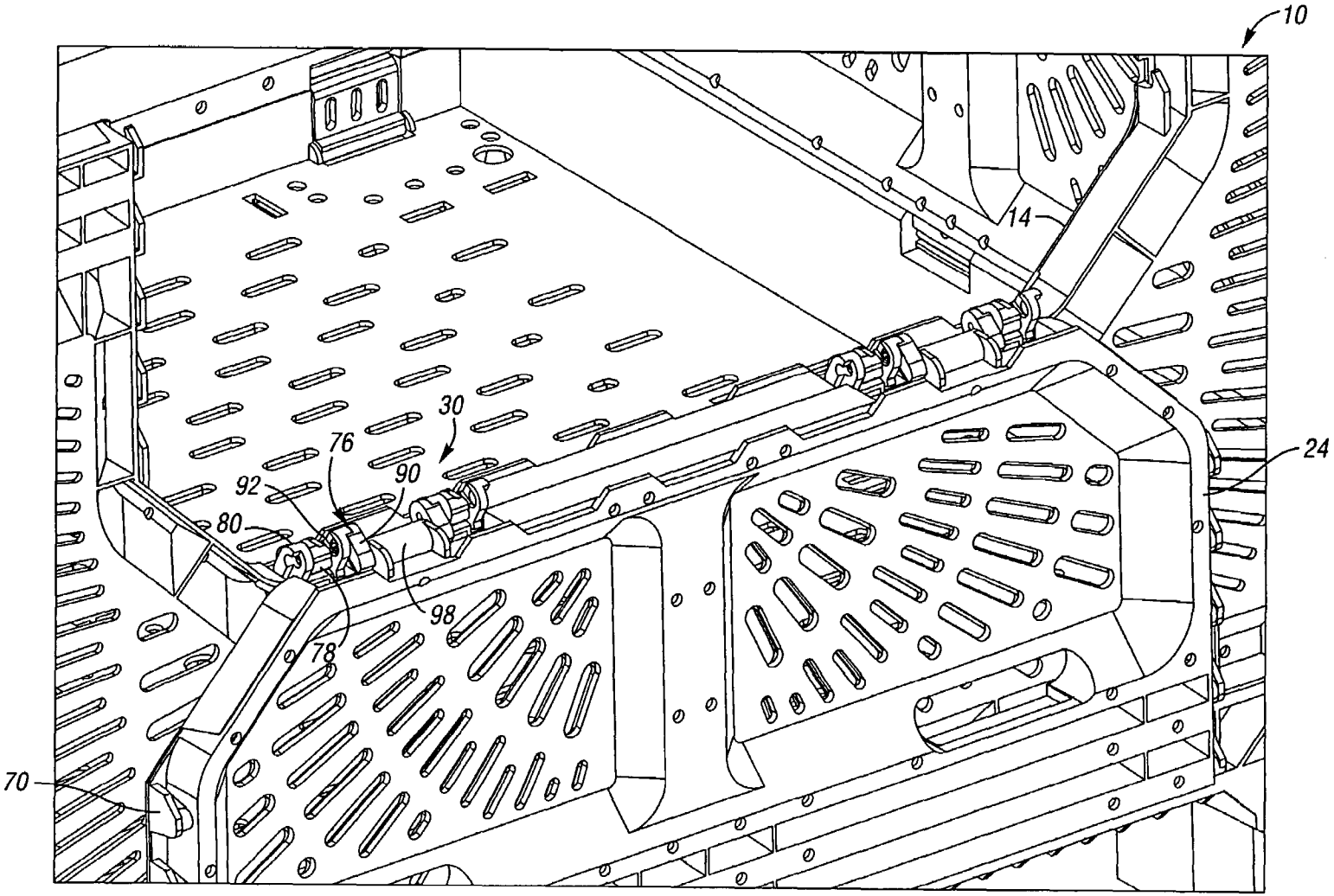
FIG. 8 is a partial perspective view illustrating the connection between the door and the wall with the door in the open, downward position.

In FIG. 8, the drop door 24 is parallel to and abutting the side wall 14. The pivot pin 92 (and the third axis c, not illustrated in FIG. 8) is now above and outward of the first hinge pins 78 (and the first axis a, not illustrated in FIG. 8). The second hinge pin 88, not visible but disposed within the hinge receiver 98 on the drop door 24 (and the second axis b, not illustrated in FIG. 8) is now outward of the first and third axes. This permits the door 24 to be displaced outwardly of the side wall 14 relative to its original position, so that the drop door 24 can lie parallel to and adjacent the side wall 14.

Figure 9:
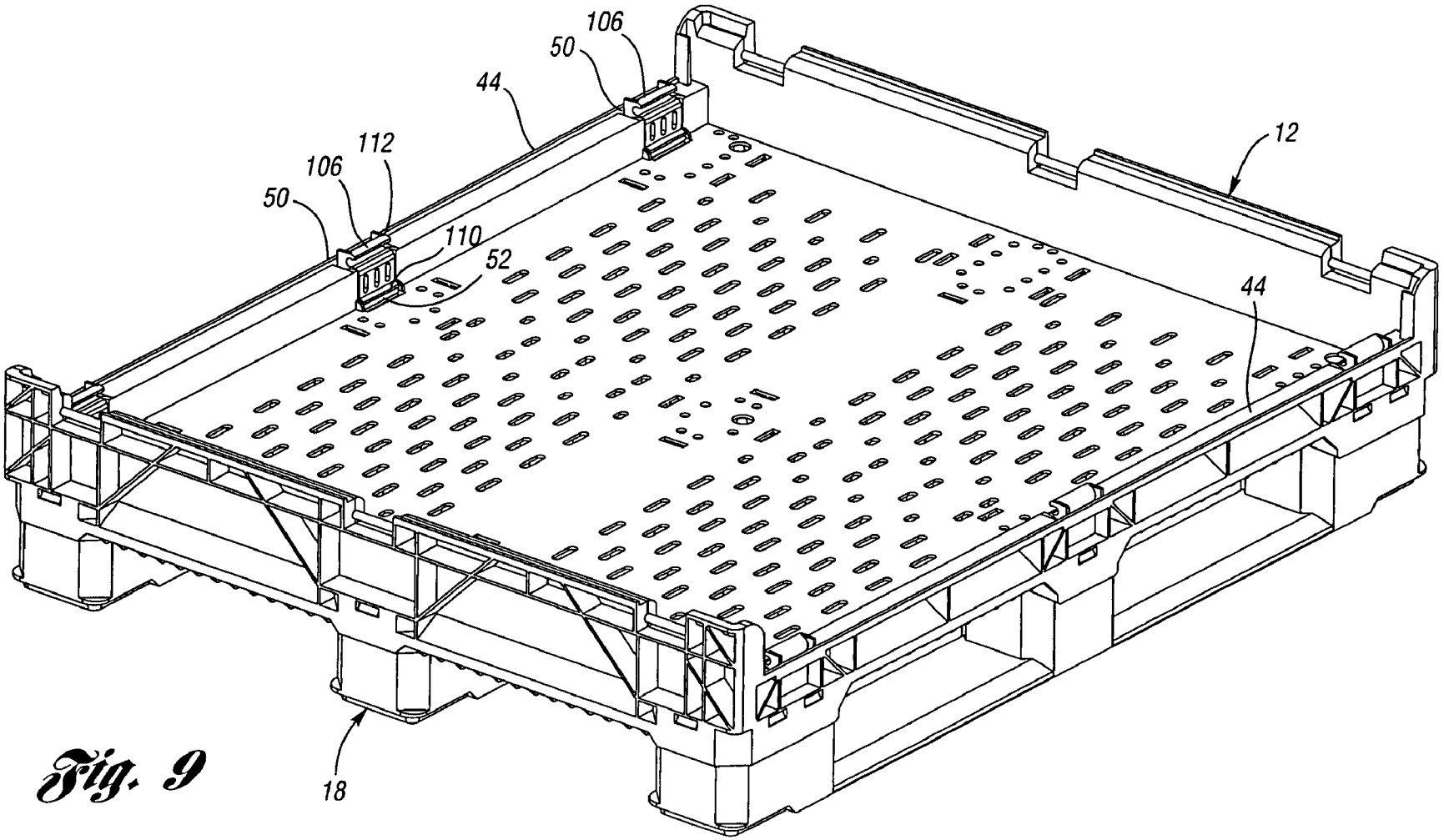
FIG. 9 is a perspective view of the base and supports with the side wall hinge members installed thereon

FIG. 9 is a perspective view of the base 12 and supports 18 with the hinge members 106 installed in the lower hinge member 50 of the lower side wall portions 44.

Figure 10:
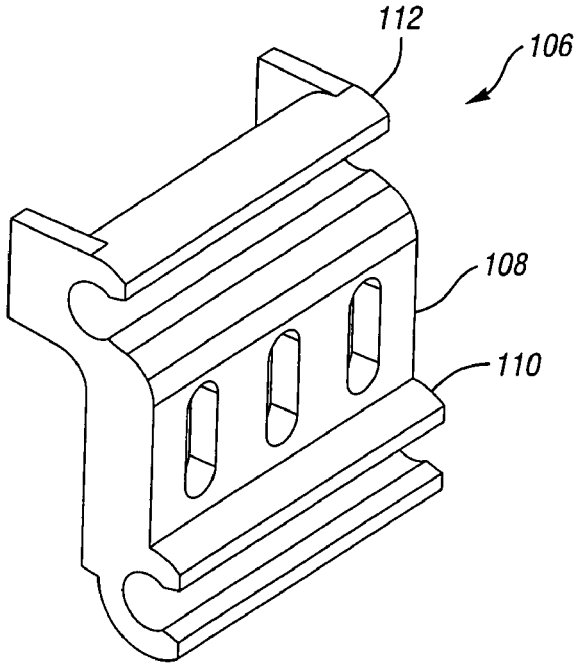
FIG. 10 is an enlarged view of one of the hinge members for connecting the side walls to the base.

FIG. 10 illustrates the hinge member 106 in more detail. The hinge member 106 includes a central body portion 108. A lower hinge receiver 110 is offset forwardly from the lower edge of the central body portion 108. An upper hinge receiver 112 is offset rearwardly of the central body portion 108. Both the lower hinge receiver 110 and the upper hinge receiver 112 open forwardly.

Figure 10A:
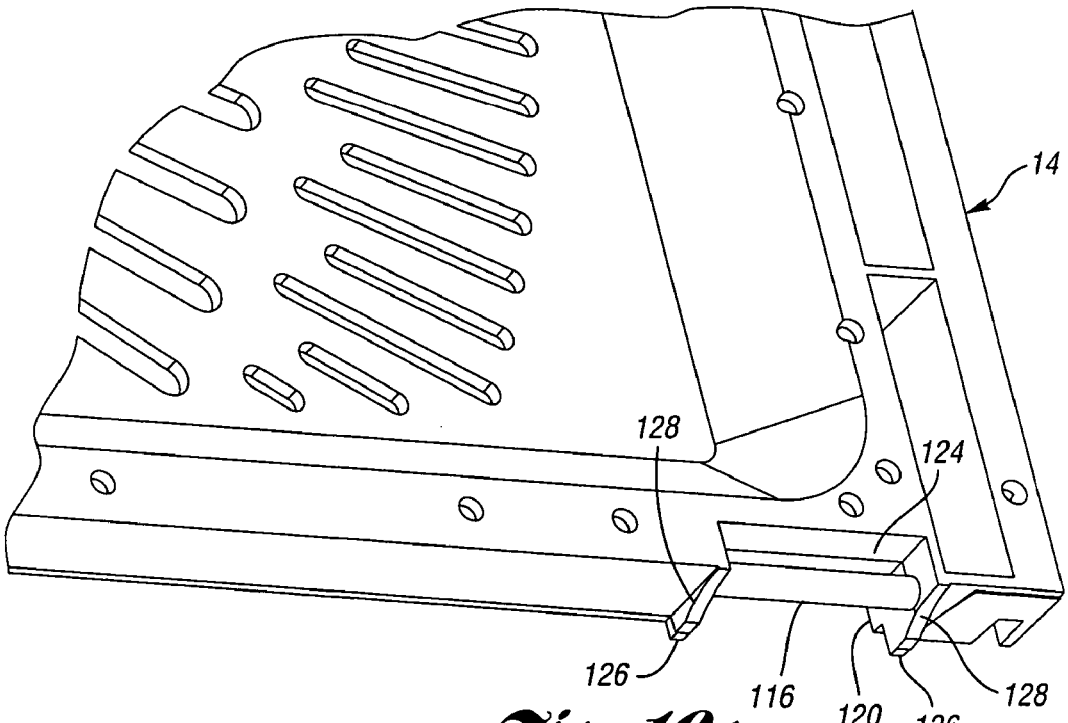
FIG. 10*a* is an enlarged view of one of the upper hinge members on a lower edge of one of the side walls.

FIG. 10*a* is an enlarged view of one of the upper hinge members 120 on a lower edge of one of the side walls 14. The upper hinge member 120 includes the integrally molded hinge pin 116 extending between walls of a recess 124. On either side of the recess 124, an interlocking member 126 protrudes downwardly from the lower edge of the side wall 14. The interlocking member 126 includes an arcuate surface 128 complementary to the arcuate surfaces 54 on either side of the lower hinge members 50 on the base 12 (FIG. 3).

Figure 10B:
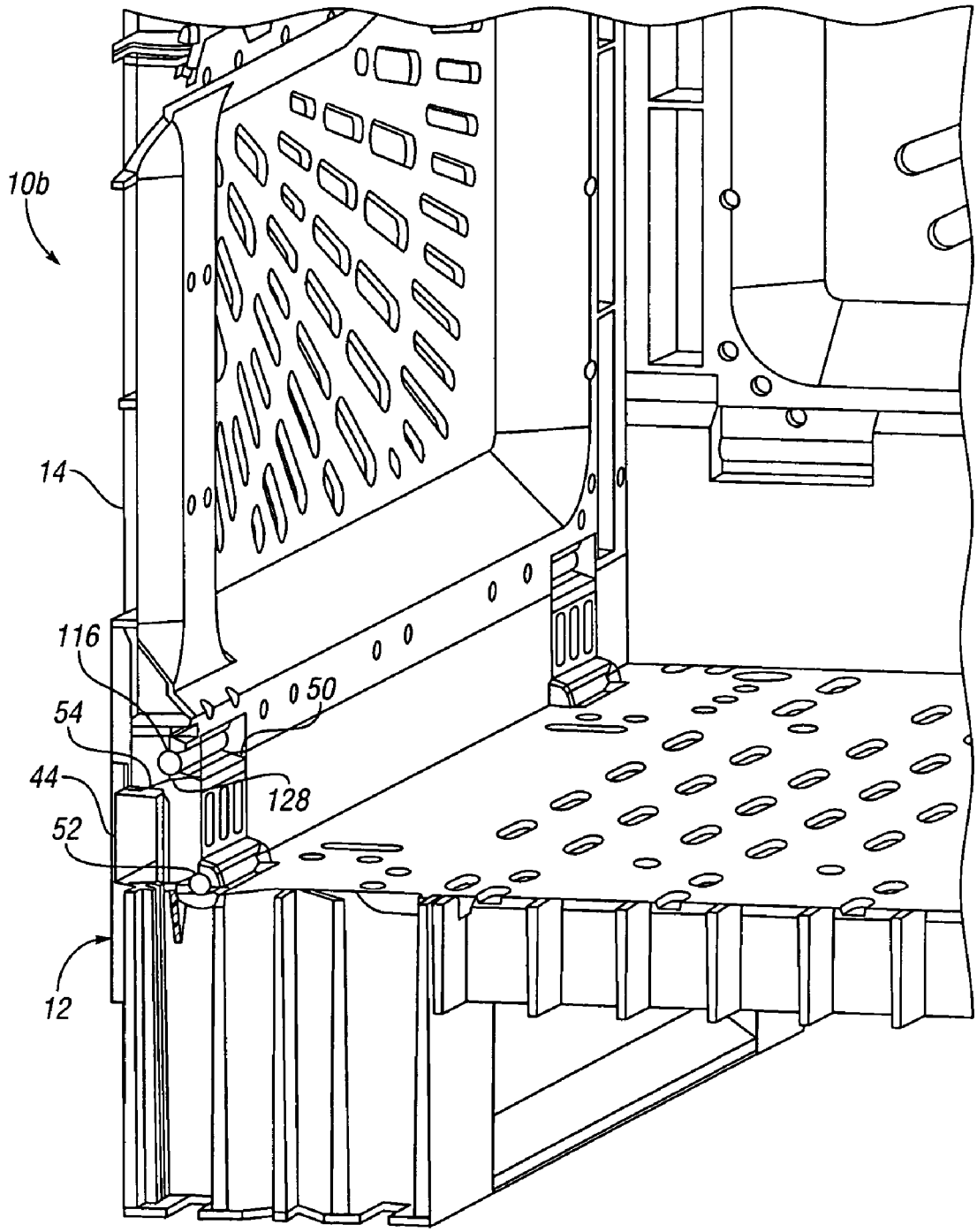
FIG. 10*b* is a partial sectional view through the mating arcuate surfaces of the side wall and lower side wall portion.

FIG. 10*b* is a partial sectional view through the mating arcuate surfaces 128, 54 of the side wall 14 and lower side wall portion 44. The side wall 14 as it is folded inward from the upright position must first pivot only about the lower hinge pin 52 because the arcuate surface 128 on the lower edge of the wall 14 interlocks with the arcuate surface 54 formed on the lower hinge member 50. As the arcuate surface 128 on the lower edge of the side wall 14 slides away from the arcuate surface 54 after rotation past a certain angle, then the side wall 14 is free to pivot about either the hinge pin 52 or the hinge pin 116 and is collapsed flat onto the floor 40 of the base 12 as shown in FIGS. 11 and 12.

Figure 11:
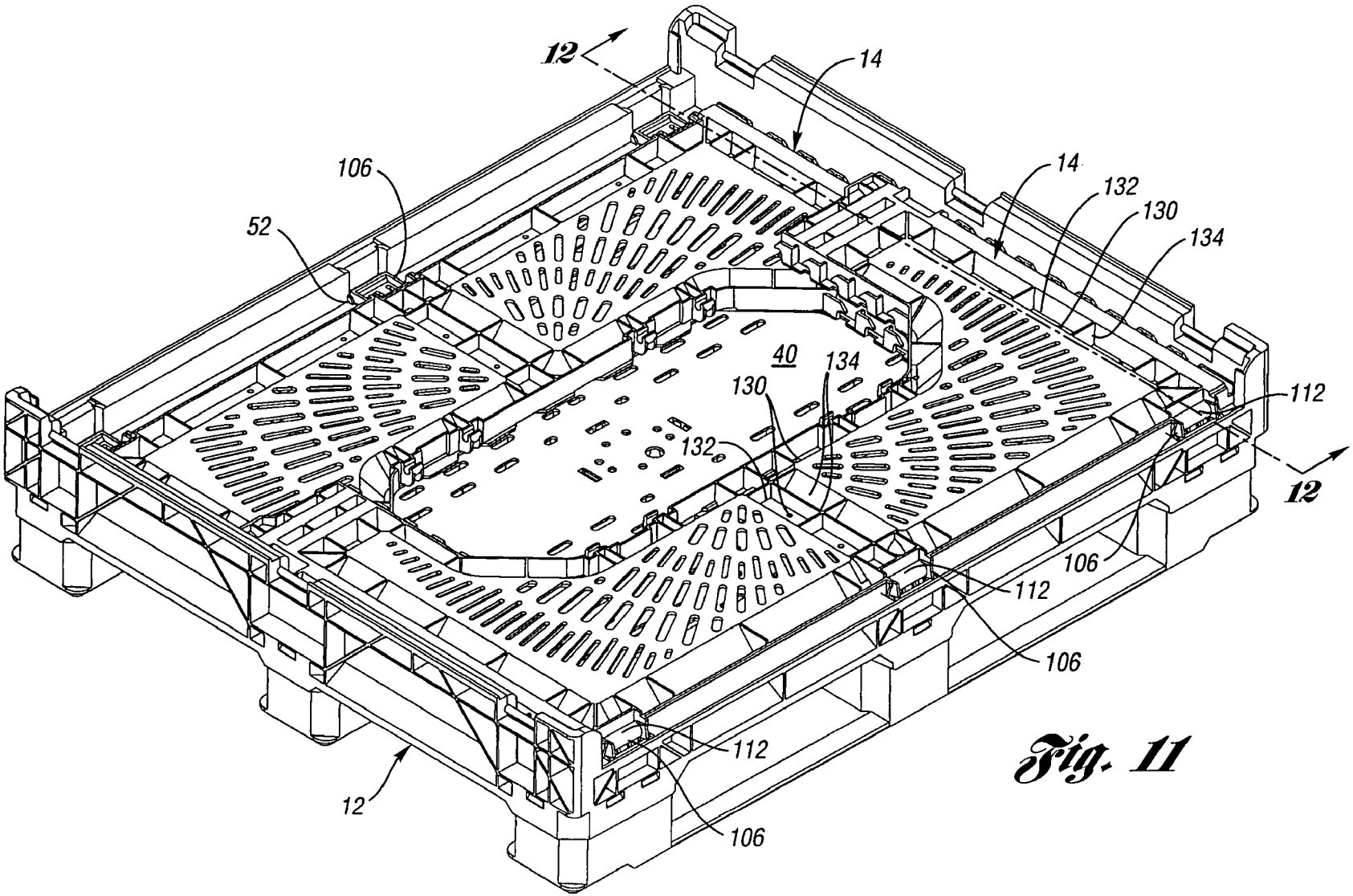
FIG. 11 is a perspective view of the side walls collapsed onto the base, with the doors and end walls removed for clarity.
Figure 12:
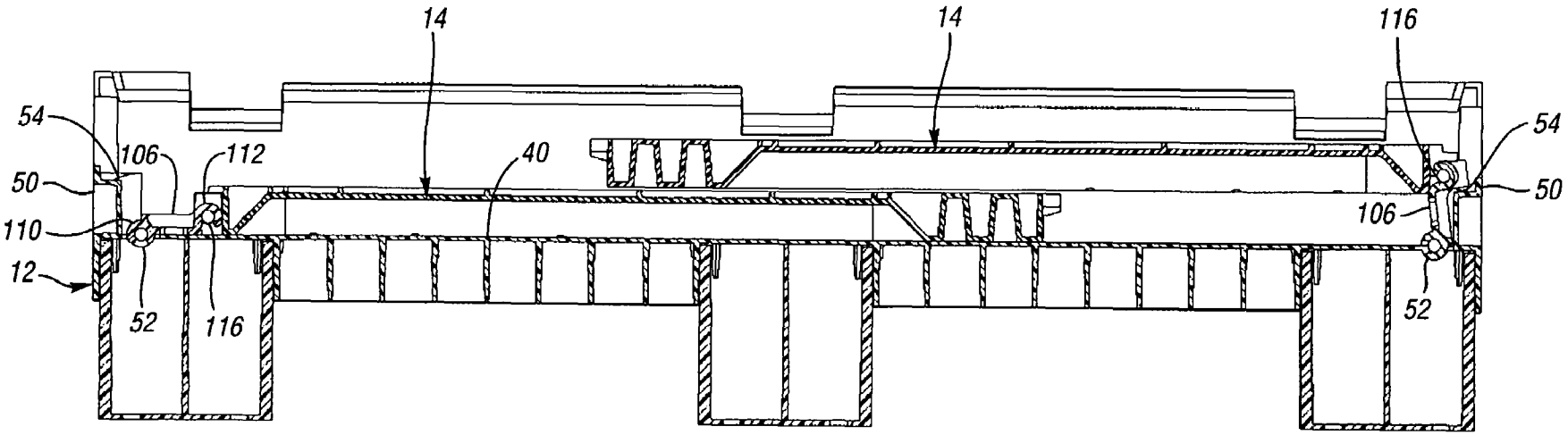
FIG. 12 is a sectional view through line 12-12 of FIG. 11.

FIG. 11 is a perspective view showing the side walls 14 collapsed onto the base 12, with the end walls 16 and doors 24 removed for purposes of illustration. FIG. 12 is a sectional view taken along line 12-12 of FIG. 11. One side wall 14 (to the left of FIGS. 11 and 12) has been pivoted substantially about the lower hinge pin 52 formed integrally with the base 12 and lies flat on the floor 40 of the base 12. The opposite side wall 14 pivots substantially only about the upper hinge receiver 112 of the hinge member 106 so that it lies flat on the other side wall 14. In this manner, the overall height of the bin 10 is reduced when the walls are in the collapsed position. Drainage holes 130 are formed through interior panels 132 formed between external ribs 134 including the interior panels 132 immediately adjacent the hinge receivers 96, to facilitate drainage when the bin 10 is in the collapsed position.

Figure 13:
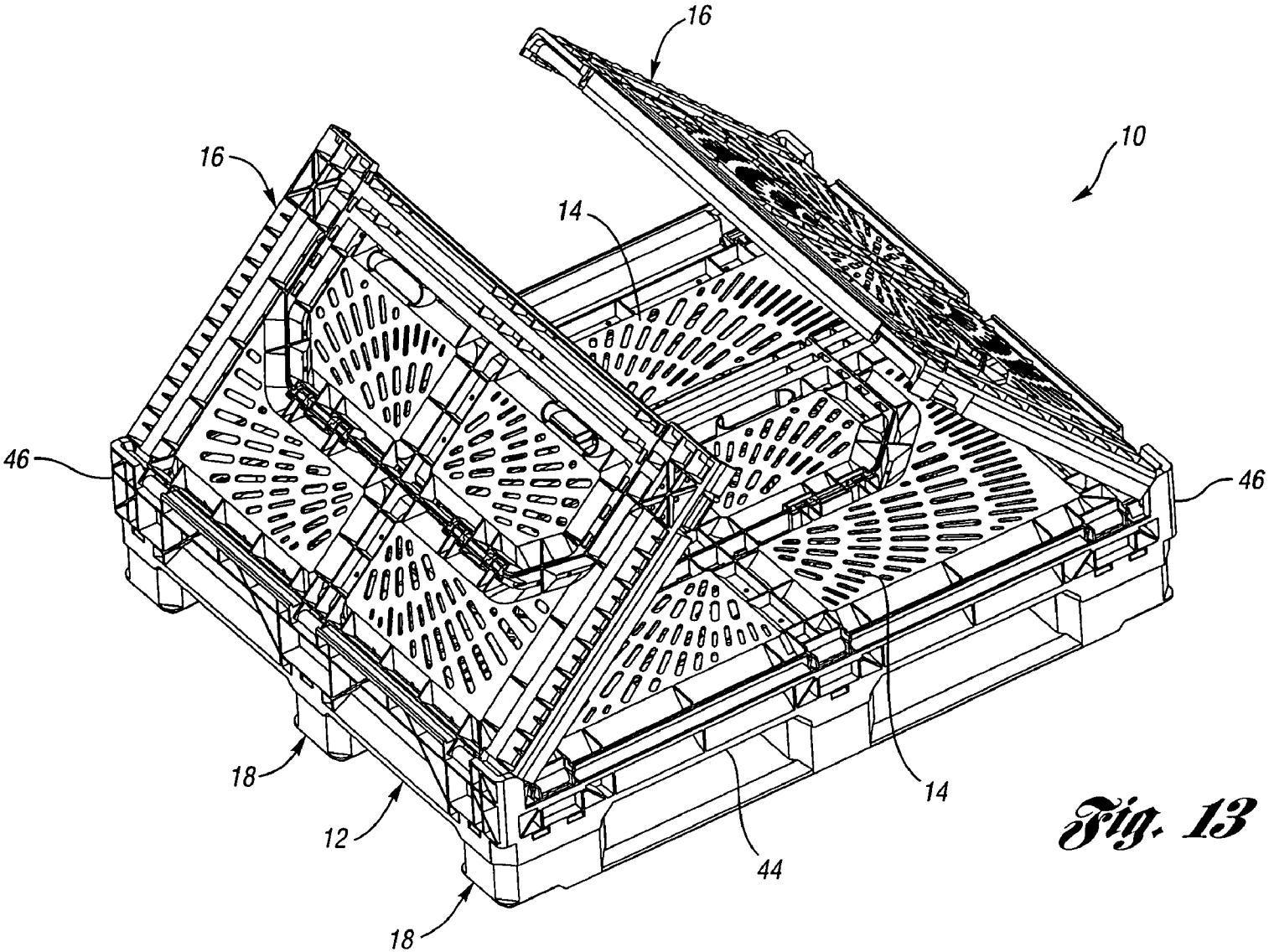
FIG. 13 is a perspective view of the bin of FIG. 1 with the side walls collapsed onto the base and the end walls pivoted between the upright and collapsed position.
Figure 14:
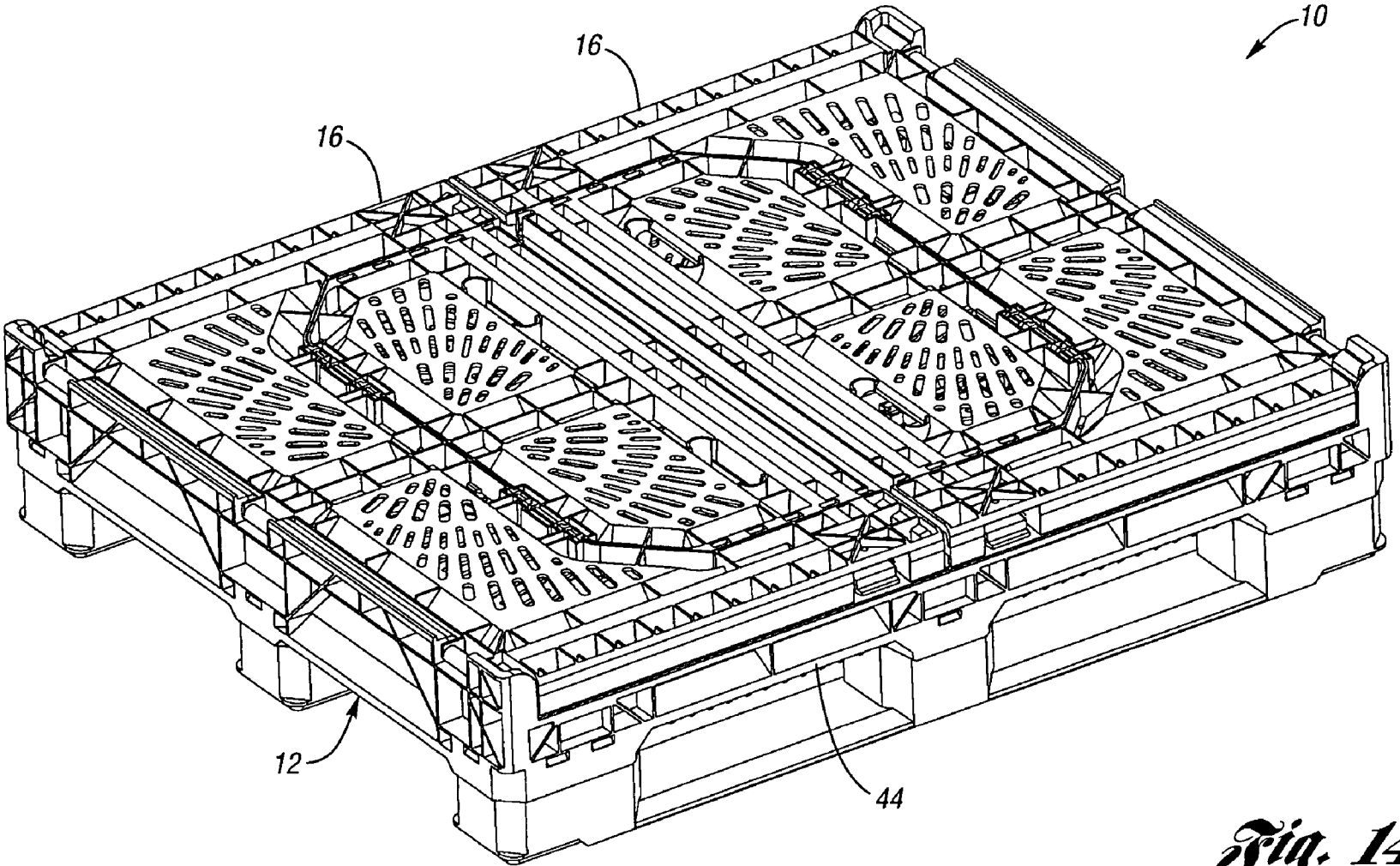
FIG. 14 illustrates the bin of FIG. 13 with the end walls collapsed onto the base.
Figure 15:
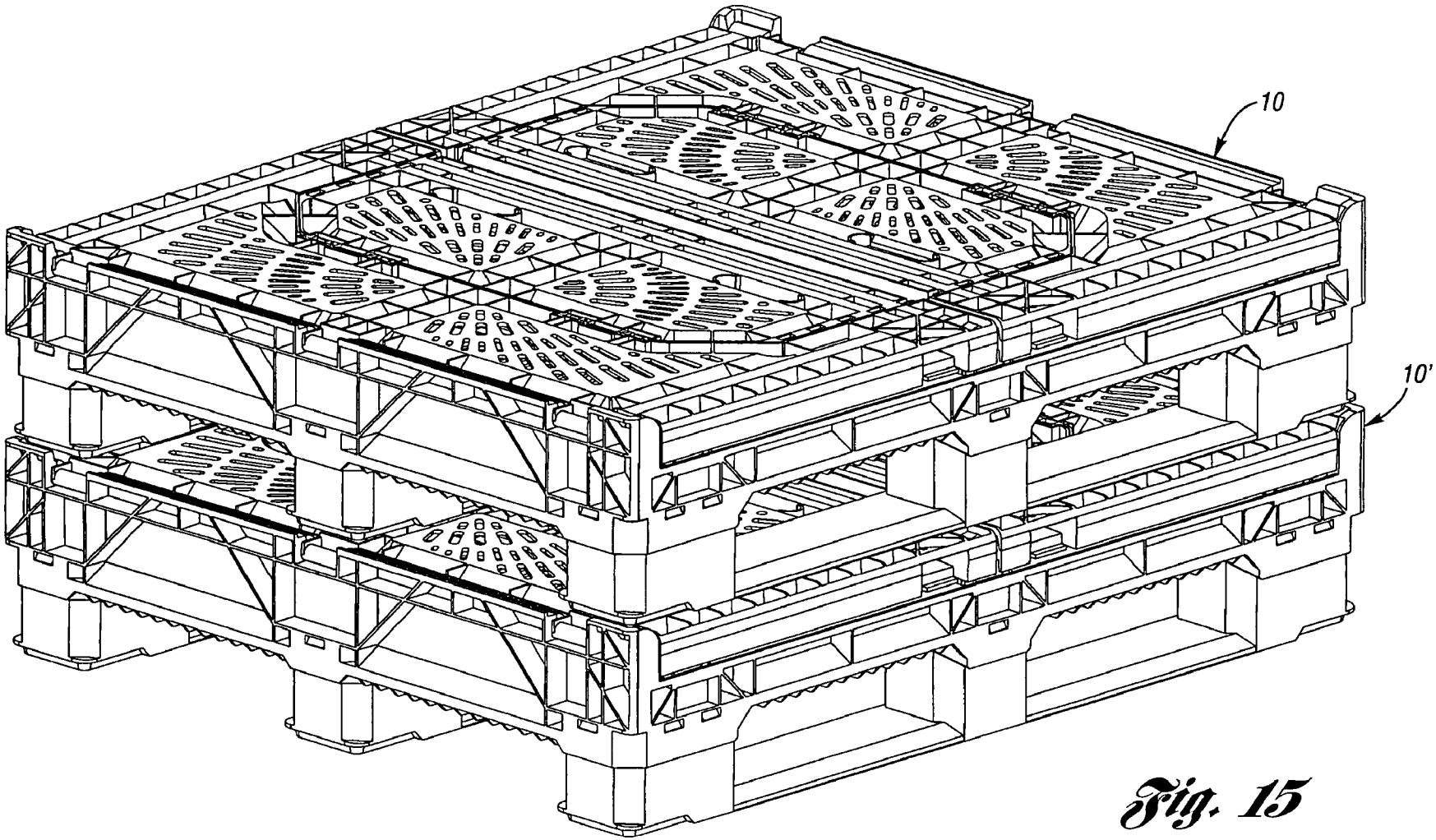
FIG. 15 illustrates the bin of FIG. 14 stacked on a like collapsed bin.

FIG. 13 illustrates the next step in collapsing the bin 10 (with all the doors 24 and with the end walls 16 shown). The end walls 16 are then pivoted about the hinge pins 62 (FIG. 3) formed in the lower end wall portions 46 of the base 12. Because the end walls 16 do not overlap, the end walls 16 lie flat on the side walls 14 and on the lower side wall portions 44, as shown in FIG. 14. In FIG. 14, the collapsed bin 10 occupies a minimum amount of space for the lowest cost in shipping. As shown in FIG. 15, the collapsed bin 10 can be stacked on other similar bins 10', minimizing the space occupied during shipping or storage.

Figure 16:
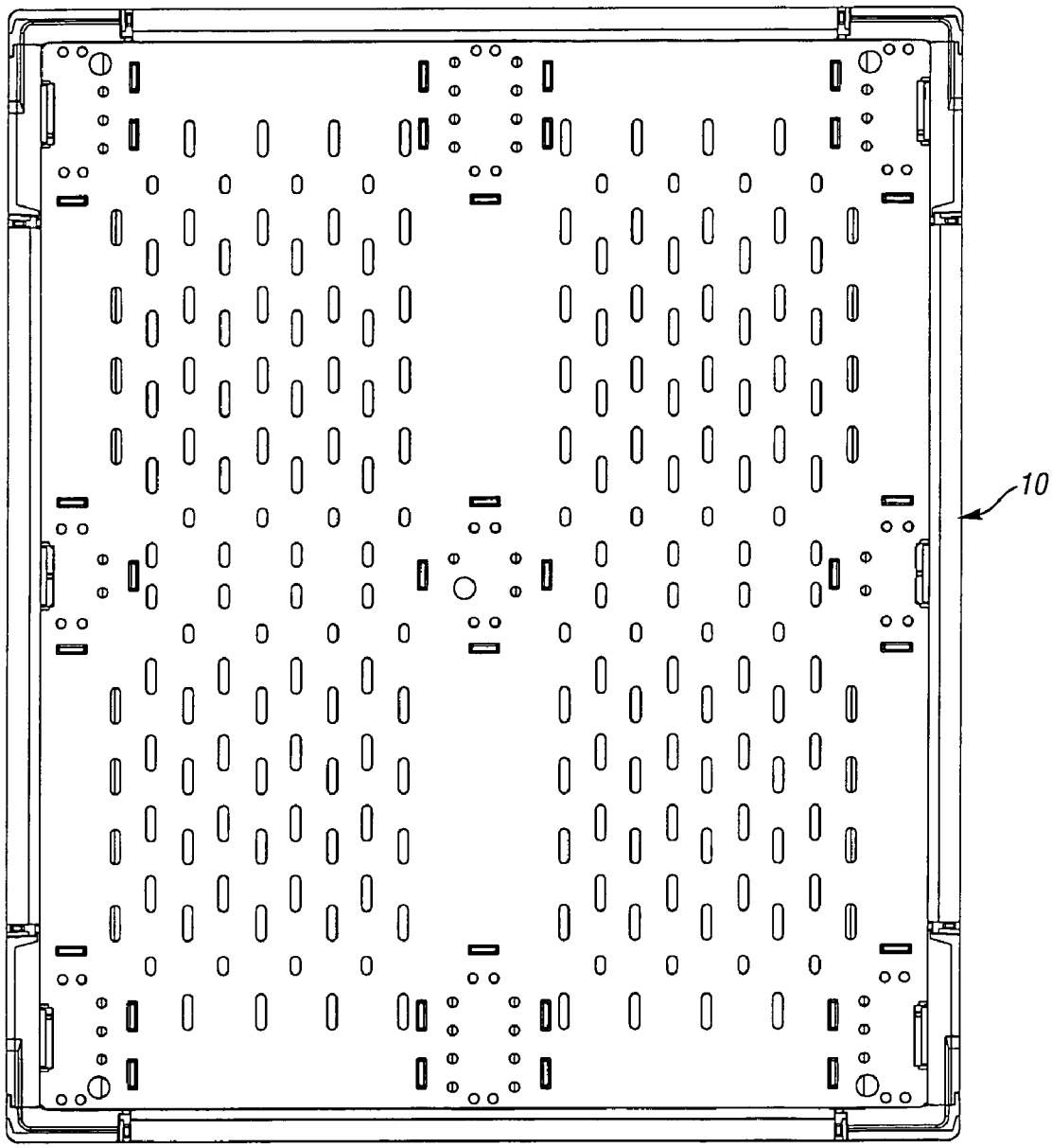
FIG. 16 is a top view of the bin of FIG. 1.
Figure 17:
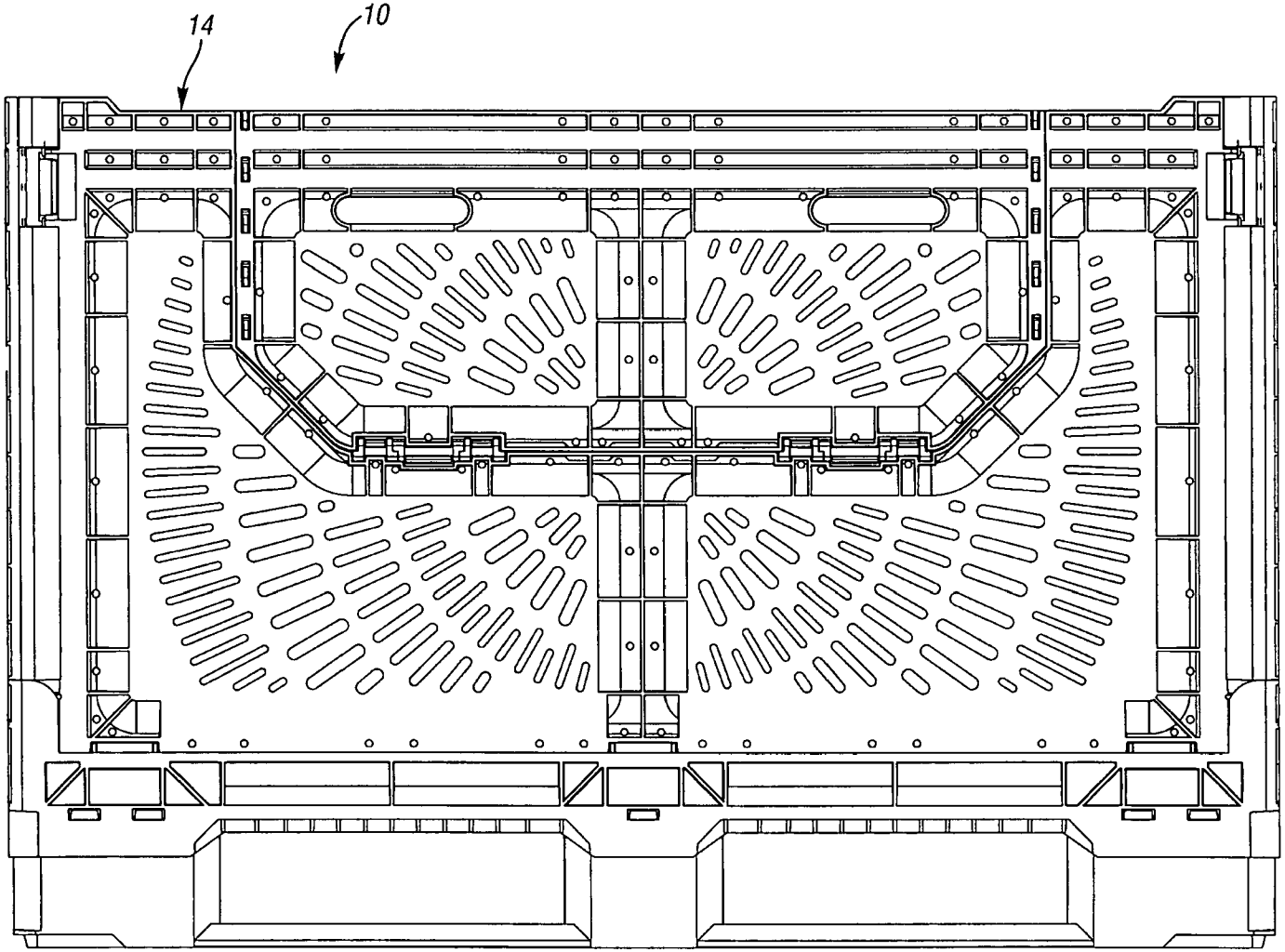
FIG. 17 is a side view of the bin of FIG. 1.
Figure 18:
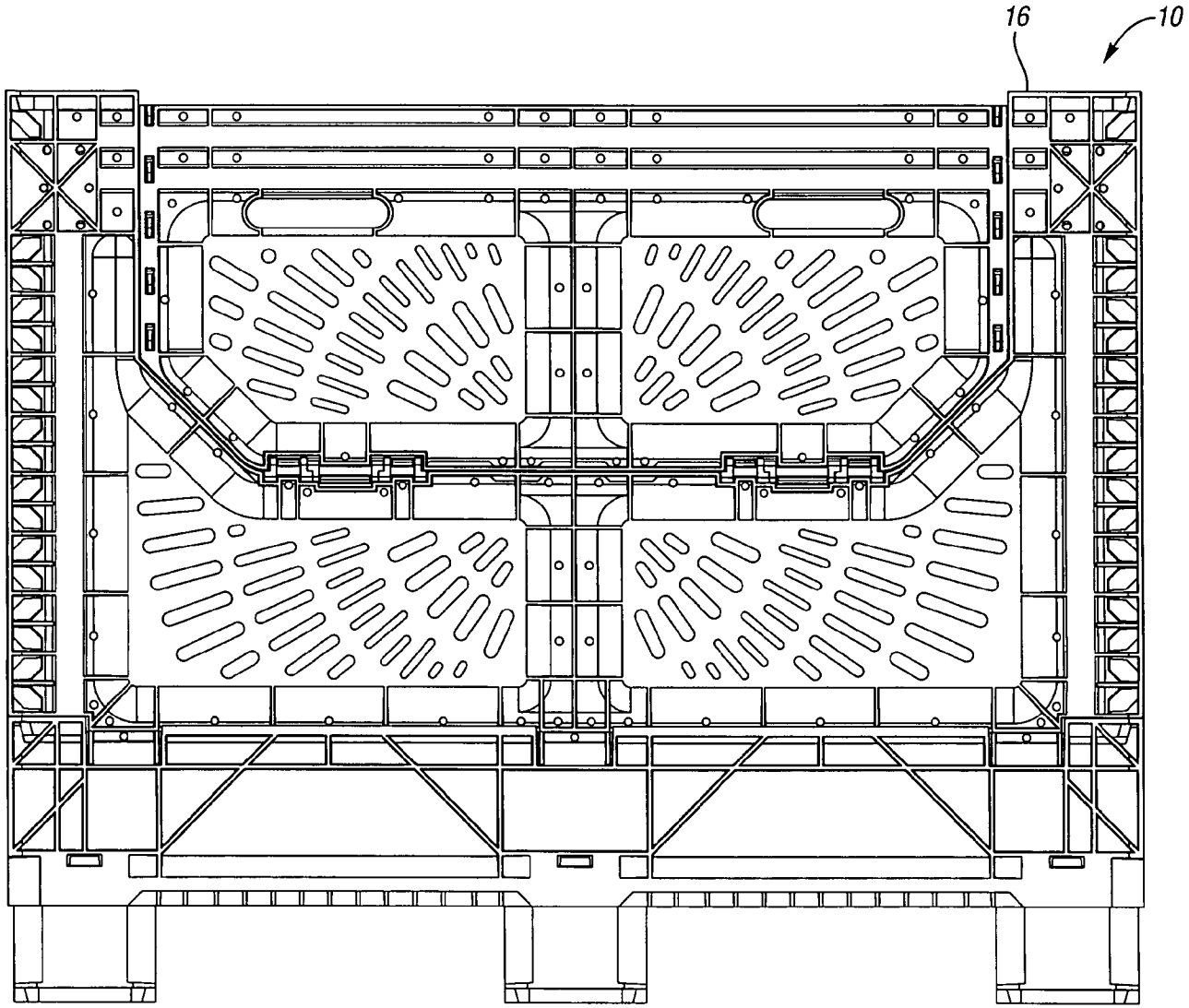
FIG. 18 is an end view of the bin of FIG. 1.
Figure 19:
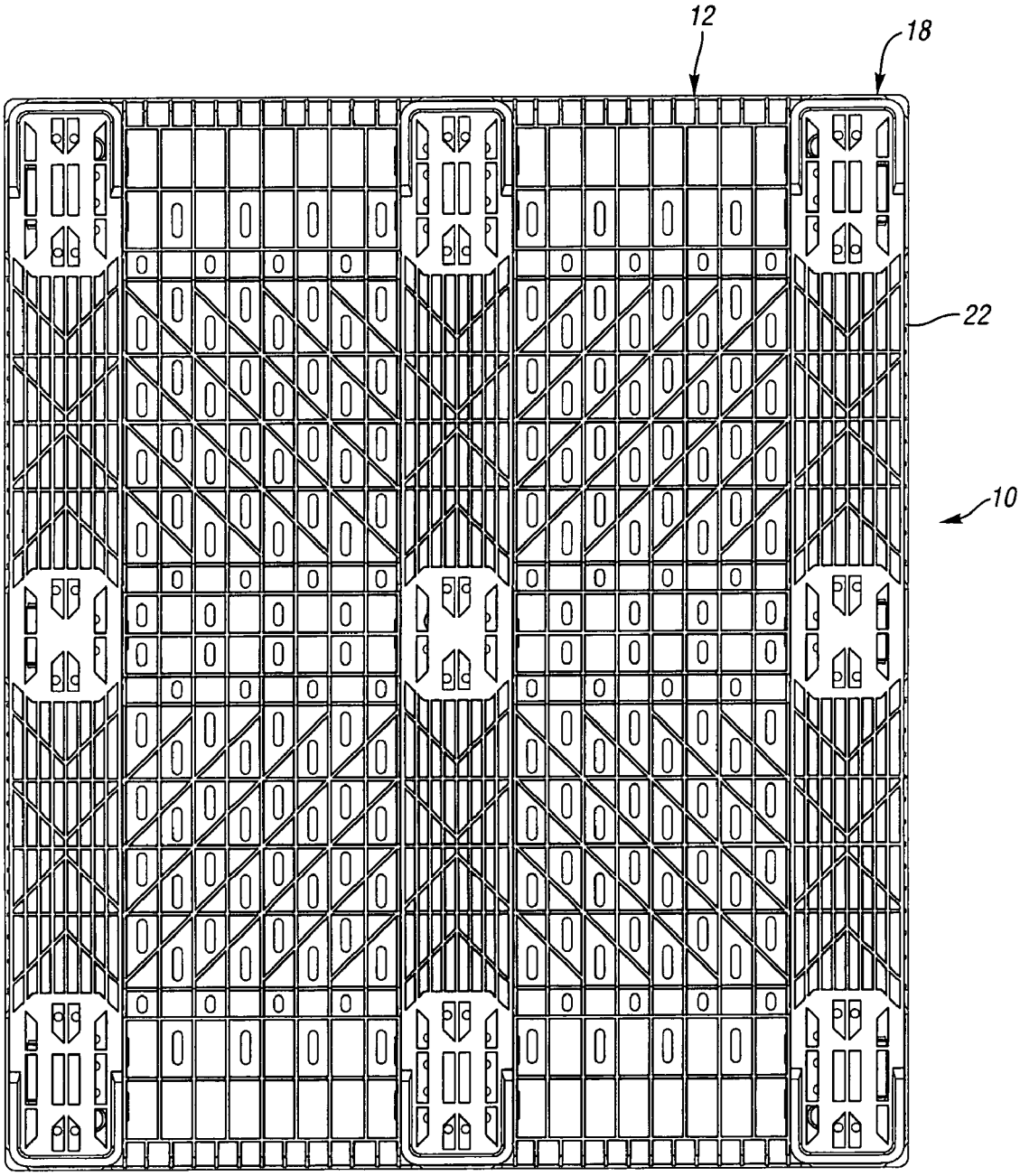
FIG. 19 is the bottom view of the bin of FIG. 1.

FIG. 16 is a top view of the bin 10. FIG. 17 is a side view of the bin 10. FIG. 18 is an end view of the bin 10. FIG. 19 is a bottom view of the bin 10. The components of the bin 10 are preferably plastic or polymer composite, such as polypropylene, HDPE, nylon, or other suitable material formed by injection molding or other suitable process.

Figure 20:
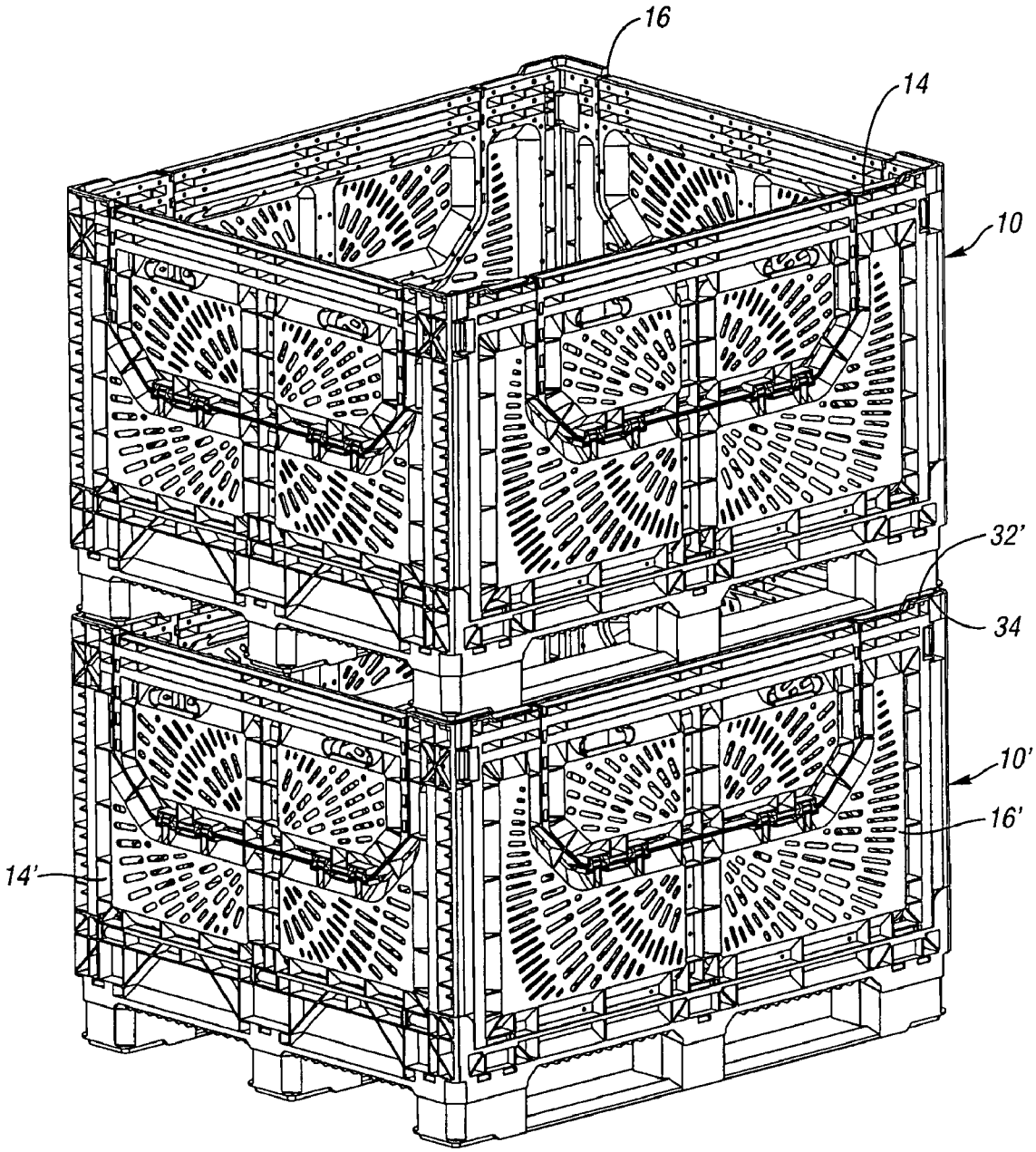
FIG. 20 illustrates the assembled field bin of FIG. 1 stacked on a similar field bin.

FIG. 20 illustrates the field bin 10 of FIG. 1 stacked on a similar field bin 10', with both field bins 10, 10' in the assembled position with the side walls 14 and end walls 16 in the upright position. The ridges 32' on the upper edges of the side walls 14' and end walls 16' of the lower field bin 10' are received in the recesses 34 of the upper field bin 10.

The field bin 10 is easy to repair, with a minimum number of replacement parts being necessary. Replacement of all parts can be done with simply a hammer and screwdriver.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of pallets and containers that would benefit from the present invention. As indicated above, some of these features are applicable to pallets, containers and to collapsible containers independently. Thus, unless otherwise clearly specified in the claims, the claims to pallets are not limited to pallets with walls or collapsible walls, and the claims to containers are not limited to pallets or collapsible walls.

What is claimed is:

1. A container comprising:

a base;

a wall movable between an upright position and a collapsed position;

a hinge connecting the wall to the base, the hinge including a first axis and a second axis offset from the first axis, the hinge locked when the wall is in the upright position to prevent rotation about the second axis but permit inward rotation of the wall about the first axis, and unlocked when the wall is not in the upright position to permit inward rotation of the wall about the second axis.

2. The container of claim 1 wherein the hinge permits rotation about the first axis and the second axis when the wall is not in the upright position.

3. The container of claim 1 wherein the hinge becomes unlocked based upon rotation of the wall from the upright position to a first position between the upright position and the collapsed position.

4. The container of claim 1 wherein the wall is generally parallel to the base when the wall is in the collapsed position.

5. The container of claim 1 further including a lower wall portion extending upward from the base, the wall connected by the hinge to the lower wall portion of the base.

6. The container of claim 1 wherein the hinge includes a hinge member pivotably connected to the base about the first axis and pivotably connected to the wall about the second axis.

7. The container of claim 6 wherein the wall is locked against rotation relative to the hinge member when the wall is in the upright position.

8. The container of claim 7 wherein the wall is locked against rotation relative to the hinge member when the wall is in any position between the upright position and a first position, the first position between the upright position and the collapsed position.

9. The container of claim 6 further including a first interlocking feature on the wall that prevents rotation about the second axis but permit rotation about the first axis when the wall is in the upright position.

10. The container of claim 9 further including a second interlocking feature on the base that is complementary to the first interlocking feature.

11. The container of claim 10 wherein at least one of the first interlocking feature and the second interlocking feature includes an arcuate surface.

12. The container of claim 11 wherein the arcuate surface has a center point not aligned with the second axis.

13. The container of claim 12 wherein the center point is substantially aligned with the first axis.

14. The container of claim 1 wherein the base includes an integral lower wall portion extending upwardly therefrom, the wall having a lower edge contacting an upper edge of the lower wall portion to prevent the inward rotation of the wall about the second axis.

15. The container of claim claim 1 wherein a lower edge of the wall includes an arcuate surface interlocking with an arcuate surface on the base to prevent the inward rotation of the wall about the second axis when the wall is in the upright position.

16. A container comprising:

a base;

a wall movable between an upright position and a collapsed position;

a hinge connecting the wall to the base, the hinge including a hinge member pivotably connected to the base about a first axis and pivotably connected to the wall about a second axis offset from the first axis, the hinge locked when the wall is in the upright position to prevent rotation about the second axis but permit rotation about the first axis, and unlocked when the wall is not in the upright position to permit rotation about the second axis;

a first interlocking feature on the wall that prevents rotation about the second axis but permits rotation about the first axis when the wall is in the upright position; and a second interlocking feature on the base that is complementary to the first interlocking feature, at least one of the first interlocking feature and the second interlocking feature including an arcuate surface.

17. The container of claim 16 wherein the arcuate surface has a center point not aligned with the second axis.

18. The container of claim 17 wherein the center point is substantially aligned with the first axis.

19. A container comprising:

a base;

a wall movable between an upright position and a collapsed position;

a hinge connecting the wall to the base, the hinge including a first axis and a second axis offset from the first axis, the hinge locked when the wall is in the upright position to prevent rotation about the second axis but permit rotation about the first axis, and unlocked when the wall is not in the upright position to permit rotation about the second axis, a surface of the wall contacting a surface of the base to prevent rotation of the wall about the second axis when the wall is in the upright position.

20. The container of claim 19 wherein the base including an integral lower wall portion extending upwardly therefrom, the surface of the wall contacting the integral lower wall portion to prevent rotation of the wall about the second axis when the wall is in the upright position.

21. The container of claim 20 wherein the surface of the wall is on a lower edge of the wall and is an arcuate surface interlocking with an arcuate surface on the base to prevent the inward rotation of the wall about the second axis when the wall is in the upright position.

* * * * *